US005465098A

United States Patent [19]

Fujisawa et al.

[11] Patent Number: 5,465,098

[45] Date of Patent: Nov. 7, 1995

[54] ANTENNA APPARATUS FOR TRANSCEIVER

[75] Inventors: Teruhiko Fujisawa, Suwa; Koichi Ito, Chiba, both of Japan

[73] Assignee: Seiko Epson Corporation, Tokyo, Japan

[21] Appl. No.: 81,380

[22] PCT Filed: Jul. 1, 1992

[86] PCT No.: PCT/JP92/00831

§ 371 Date: Jun. 29, 1993

§ 102(e) Date: Jun. 29, 1993

[87] PCT Pub. No.: WO93/09576

PCT Pub. Date: May 13, 1993

[30] Foreign Application Priority Data

Nov. 5, 1991 [JP] Japan ..... 3-288763

[51] Int. Cl.[6] ..... H01Q 1/12; H01Q 13/10

[52] U.S. Cl. ..... 343/718; 343/767; 343/768

[58] Field of Search ..... 343/718, 767, 343/768; 340/573, 539, 568, 693; H01Q 1/24, 13/00, 7/00, 1/12, 13/10

[56] References Cited

U.S. PATENT DOCUMENTS

| | | | |
|---|---|---|---|
| 2,507,528 | 5/1950 | Kandoian | 343/767 |
| 3,172,112 | 3/1965 | Seeley | 343/767 |
| 3,210,766 | 10/1965 | Parker | 343/743 |
| 4,419,770 | 12/1983 | Yagi et al. | 455/301 |
| 4,509,053 | 4/1985 | Robin et al. | 343/767 |
| 4,817,196 | 3/1989 | MacNak et al. | 343/718 |
| 4,873,527 | 10/1989 | Tan | 343/718 |
| 4,884,252 | 11/1989 | Teodoridis et al. | 368/10 |
| 4,973,944 | 11/1990 | Maletta | 343/718 |
| 4,975,711 | 12/1990 | Lee | 343/702 |
| 4,977,614 | 12/1990 | Kurcbart | 343/718 |
| 5,134,724 | 7/1992 | Gehring et al. | 343/718 |
| 5,144,325 | 9/1992 | Kurcbart | 343/178 |
| 5,179,733 | 1/1993 | Matsui | 455/344 |
| 5,182,568 | 1/1993 | Stamps, Jr. et al. | 343/702 |
| 5,280,296 | 1/1994 | Tan et al. | 343/718 |
| 5,280,646 | 1/1994 | Koyama et al. | 343/718 |

FOREIGN PATENT DOCUMENTS

| | | | |
|---|---|---|---|
| 0538485 | 4/1993 | European Pat. Off. . | |
| 31-5906 | 7/1956 | Japan . | |
| 58-94204 | 6/1983 | Japan . | |
| 61-26307 | 2/1986 | Japan . | |
| 63-163185 | 6/1988 | Japan . | |
| 2-140002 | 5/1990 | Japan . | |
| 3181208 | 7/1991 | Japan . | |
| 2201266 | 8/1988 | United Kingdom | H01Q 1/44 |

*Primary Examiner*—Donald Hajec
*Assistant Examiner*—Hoanganh Le
*Attorney, Agent, or Firm*—Oliff & Berridge

[57] ABSTRACT

The present invention relates to an improvement of an antenna apparatus for a transceiver that is capable of obtaining a stable operation of an antenna without being affected by different sizes of wrist bands or by a durability of a metal clasp. An antenna unit (14) is comprised of a strip shaped conductive plate (13), whose slot (13*a*) is formed in the longitudinal direction of wrist band (12), which is connected to a casing (11) of the wrist type transceiver (10). One conductive section of slot (13*a*) of the conductive plate (13) provides a feeding point (131) in order to supply a positive potential. The other conductive section (130*b*) provides a second feeding point (132) in order to fix the other conductive section (130*b*) to the ground potential. A capacitance element (19) is attached between one conductive section (130*a*) and the other conductive section (130*b*) of the conductive plate (13).

80 Claims, 14 Drawing Sheets

ANTENNA APPARATUS FOR TRANSCEIVER

BACKGROUND OF THE INVENTION

1. Field of the Invention

This invention relates to an antenna radio apparatus that is unitarily formed with a wrist band for placement on a person's wrist. In particular, this invention relates to an antenna radio apparatus capable of obtaining a stable operation of an antenna without being affected by different sizes of wrist bands, depending on the persons wearing them, and by a durability of a metal fitting used in the belt-joint of the wrist bands.

2. Related Background Art

FIG. 24 is an example of a miniature portable transmitter/receiver and, more particularly, of an antenna apparatus for a wrist type portable transceiver that is worn on a person's wrist. In FIG. 24, a wrist type transceiver 90 is comprised of a casing 92 (transceiver main body) that incorporates a transceiver circuit board, and a wrist type band 91 providing a first band 91*a* and a second band 91*b* having insulating characteristics, which are connected to both sides of the casing 92. A first strip shaped conductive plate 93*a* and a second strip shaped conductive plate 93*b* are fixed inside first band 91*a* and second band 91*b*, respectively. The first conductive plate 93*a* and the second conductive plate 93*b* are electrically connected to the transceiver circuit incorporated in the casing 92 at one of their ends. At their free end side, they are electrically connected to a metal belt-joint (hereinafter called "clasp") 91*c* and 91*d* (a fitting of the belt joint) for the first band 91*a* and the second band 91*b*.

Therefore, as shown in FIG. 24, when these bands 91*a* and 91*b* are connected to each other through clasps 91*c* and 91*d*, referring to their equivalent circuit shown in FIG. 25, a first conductive plate 93*a* and a second conductive plate 93*b* form a single looped antenna, namely an antenna unit 95, through a transceiver circuit 94 incorporated in a casing 92 and clasps 91*c* and 91*d*. Further, the side of the first conductive plate 93*a* is electrically coupled to a transceiver circuit 94 having a high frequency amplifier circuit 94*b*, a capacitor 94*a* and a variable capacitance capacitor 94*c* attached between a ground potential. The side of the second conductive plate 93*b* is fixed to the ground potential.

However a conventional antenna 95 for wrist type transceivers has problems in that the peripheral length of the loop varies, causing the inductance value of the antenna to vary, reducing an antenna gain. This occurs because band sizes are different depending on the persons who wear the transceiver. Accordingly, in this case, a problem arises in that a tuning frequency of the antenna 95, expressed by the following formula, is shifted, and an antenna gain is lowered.

$$f=1/[2\pi, (LC)^{1/2}]$$

f: Tuning Frequency

L: Inductance of Antenna

C: Capacitance

The increased number of times a wrist type band 91 is placed on and off the person's wrist correspondingly gradually raises a contact resistance value of a contact portion due to a deterioration of the shape and surface condition of the conductive clasps 91*c* and 91*d*. This disadvantageously results in a larger resistance loss of the antenna 95 together with a degradation of the antenna gain.

Therefore, in order to improve its structure, it is necessary to realize an antenna apparatus for transceivers capable of obtaining a stable operation of an antenna without being affected by different sized wrist bands, depending on the persons who wear them, and by a durability of a metal fitting of the clasp.

SUMMARY OF THE INVENTION

An objective of the present invention is to realize an antenna apparatus for a transceiver that is capable of obtaining a stable operation of the antenna without being affected by different sizes of wrist bands, depending on the persons wearing them, and by a durability of a metal fitting used in the clasp.

In order to achieve the above object, an antenna apparatus for a transceiver according to the present invention is characterized in that it includes a wrist band having an antenna provided by a strip shaped conductive plate, with a slot formed in the longitudinal direction of the conductive plate. Namely, an antenna apparatus for a transceiver according to the present invention is characterized in that the antenna structure does not include a loop formed by a ring shaped conductive plate fixed to and including a coupling of a wrist band, but instead is an antenna that functions as a slot antenna, and is formed by a conductive plate having a slot.

FIG. 1 shows an example of the basic structure of the above mentioned structure. According to FIG. 1, a case 11 is connected to a wrist band 12 that is fixed to a conductive plate 13 comprised of a strip shaped stainless plate having a slot formed in the longitudinal direction of the stainless plate. The conductive plate 13 itself is an antenna 14 and functions as a slot antenna. The antenna 14 is capable of being mounted on a person's wrist with a wrist band 12. Furthermore, the peripheral length of slot 13*a* is determined by its own size and shape, and is not affected by different sized wrist bands, depending on the persons who wear it.

Therefore, antenna 14 is capable of obtaining excellent antenna operation, without changing an inductance value of the antenna 14, without being affected by placement on the wrist or not, and without being affected by different sizes of the wrist band, depending on the persons who wear it.

When it is mounted on the person's wrist, a slot 13*a* formed on the conductive plate 13, large enough relative to the wavelength, opens in the external peripheral direction of the wrist band 12. As a result of this structure, non-directivity characteristics of the antenna 14 are improved.

As shown in FIG. 4, when a feed circuit 15 is attached to a conductive plate 13 in order that an electrical field "E" is generated at slot 13*a*, the slot 13*a* radiates an electromagnetic wave. The antenna 14 reacts mostly to a magnetic field component in the horizontal direction of the wrist band 12. When the transceiver is put on the person's body, its electric field is weakened; on the other hand, its magnetic field is strengthened. Therefore, this structure provides a magnetic field detecting type of antenna, and obtains good results as an antenna apparatus for a transceiver. Accordingly, the magnetic field detecting type of antenna has high sensitivity when it is put on the person's body. This feature is a necessary condition for the wrist type of transceiver.

It is possible to provide any type of clasp desired in order to place the wrist band on the person's wrist. When the wrist band is formed of a first band and a second band connected to both sides of a casing respectively, at least one of the bands includes an antenna having a strip shaped conductive plate with a slot formed in its longitudinal direction.

Further, when the wrist band is composed of a first band and a second band connected to both sides of a casing respectively, it is possible to provide a first conductive plate and a second conductive plate whose slots are formed from the casing edge and extend in the longitudinal direction, to form one antenna unit. In this case, at the side adjacent to the casing, the end portions of one side of a first conductive plate and of its other side are divided. The end portions of one side of a second conductive plate and of its other side also are divided, and are electrically connected to each other and to the end portions of the first conductive plate through two electric paths.

An antenna apparatus for a transceiver having the above mentioned features includes an electric path that includes a circuit pattern of a transceiver circuit board incorporated in a casing, and sometimes includes a wiring pattern also formed along the internal peripheral length of the casing. In this case, it is possible to connect directly and electrically the side of the conductive plate, the side of the circuit pattern and the side of the wiring portion. Furthermore, it is possible to connect these sides electrically through a conductive terminal provided on the side of the case or on the side of the conductive plate.

According to the present invention, it is desirable to provide an antenna having a capacitor element attached on both sides of a slot of a conductive plate, in order that the tuning frequency can be adjusted to a determined value. With respect to the method of feeding a signal to the conductive plate, an arrangement is provided so that either a positive or a negative potential is fed to either side of the conductive plates opposing each other and traversing the slot. The other side of the conductive plate is fixed to a ground potential, to form an unbalanced type circuit. Also, an arrangement where both sides of the conductive plates are fed by the transceiver circuit board to form a balanced type circuit may be adopted.

A feeding point may also be shifted from the center position of the conductive plate in the longitudinal direction to the end of the conductive plate, resulting in an adjustment of the impedance of the antenna.

Further, it is desirable to fill the slot of the conductive plate with a dielectric material in order to tune the antenna to the same wavelength as a longer antenna even though the antenna length is not actually extended. Accordingly, when the dielectric is filled into the strip shaped slot of the conductive plate, as expressed by the following equation, the wavelength of an electromagnetic wave that propagates inside the dielectric is shortened so that the antenna gain is the same as that of a larger antenna body. Therefore, when the slot length is short, good antenna gain is realized for an electromagnetic wave having a long wavelength.

$$\lambda' = \lambda/(\epsilon^{1/2})$$

$\lambda'$: Wavelength in Dielectric $\lambda$: Wavelength in Air $\epsilon$: Dielectric Constant of Dielectric Further, it is desirable to form extended sections in the width of the slot in order to extend the peripheral slot length without changing the length of the conductive plate, so as to correspond to an electromagnetic wave having a long wavelength.

When a clasp is used to hold the wrist band on a person's wrist, it is desirable to insulate the clasp on either end of the wrist band from the conductive plate.

In this case, due to the peripheral length of a slot of the conductive plate, a stable tuning frequency is obtained that is not affected by different sizes of wrist bands depending on the persons who wear them.

DETAILED DESCRIPTION OF PREFERRED EMBODIMENTS

The present invention will be described in detail with reference to the accompanying drawings.

(The First Embodiment)

Figure 1:
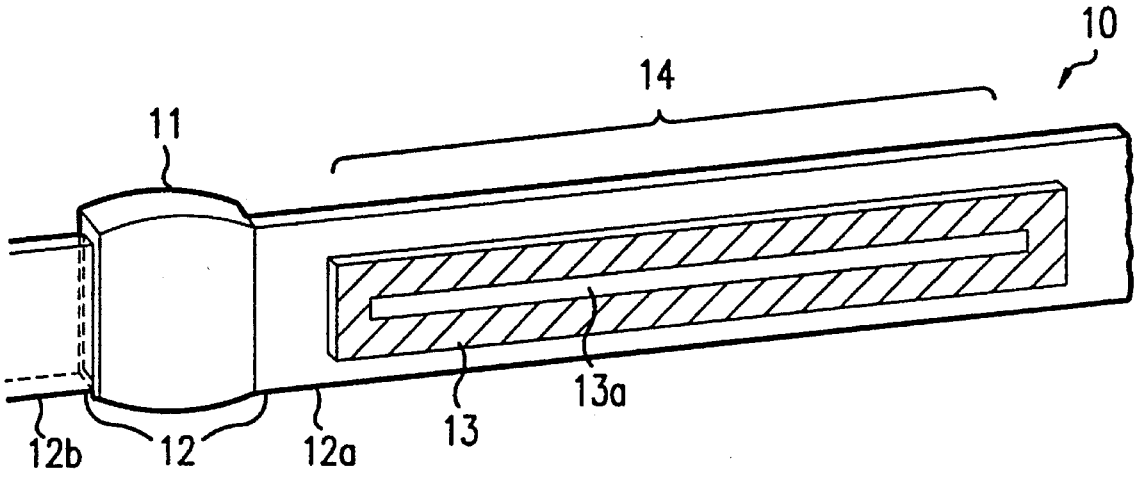
FIG. 1 is an explanatory view of the construction of an antenna for a wrist type transceiver in accordance with a first embodiment of the present invention.
Figure 2:
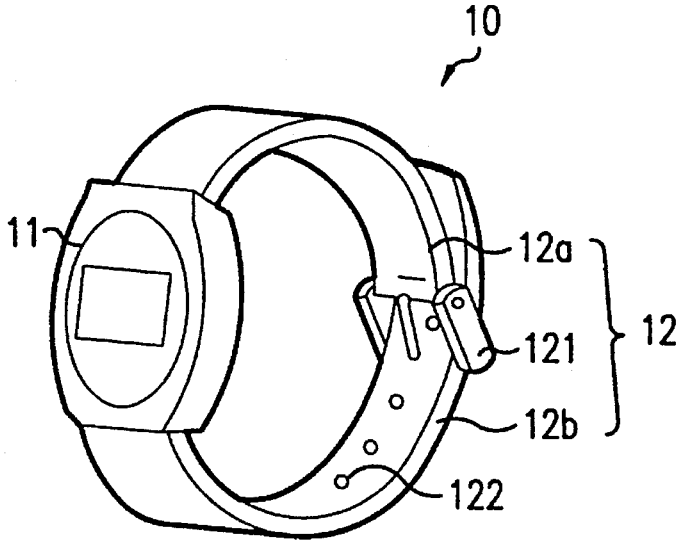
FIG. 2 is a perspective view of the external appearance of a wrist type transceiver having the antenna shown in FIG. 1.

FIG. 1 is an explanatory view of the construction of an antenna (a conductive plate) for a wrist type transceiver (an antenna apparatus for a wrist type transceiver) in accordance with a first embodiment of the present invention. FIG. 2 is a perspective view of the external appearance of the wrist type transceiver having an antenna as shown in FIG. 1. According to these figures, a wrist type transceiver 10 is comprised of a casing 11 (a transceiver body) in which is provided a circuit board for the transceiver, and a wrist band 12 having a first band 12*a* and a second band 12*b* that are connected to the side of the casing 11. A clasp 121 (a fitting of the belt-joint) is provided on the end portion of the first band 12*a*. A plurality of holes 122 capable of coupling with clasp 12*a* are formed on the second band 12*b*.

Figure 3:
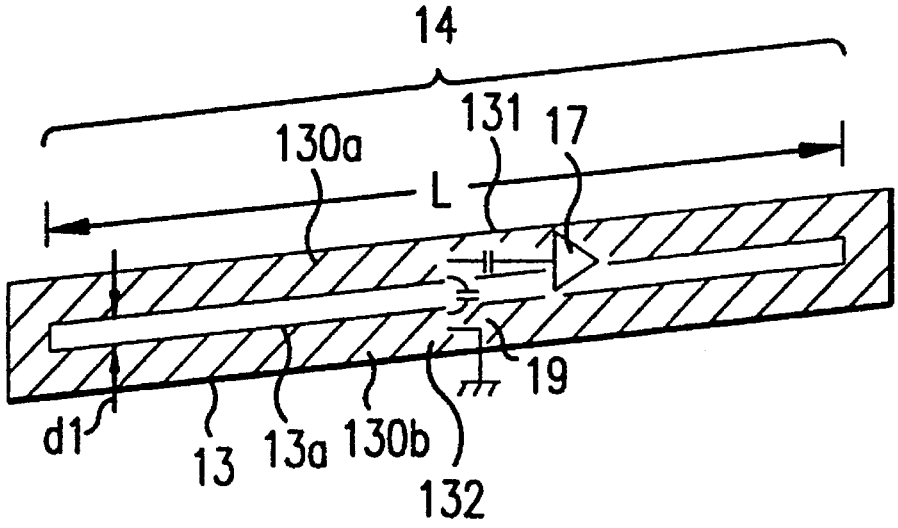
FIG. 3 is a construction view of a wrist type transceiver having the antenna shown in FIG. 1.

As shown in FIG. 1, a strip shaped conductive plate 13 is fixed unitarily inside of the first band 12*a*. Slot 13*a* is provided in band 13, and has a width of d1, and is formed in the longitudinal direction of band 13. Conductive plate 13 forms an antenna. As shown in FIG. 3, in order to supply a positive potential to plate 13, a first feeding point 131 of a high frequency amplifier circuit section 17 (feeding circuit, circuit board for transceiver) is provided on either side of a conductive portion 130*a* of the conductive plate 13*a*. A second power supply point 132 is fixed on the other side of a conductive section 130*b*, and is at ground potential. This structure is known as an unbalanced type of feeding.

Further, near the first and the second feeding points 131 and 132, a capacitor element 19 is attached between the conductive section 130*a* and the conductive section 130*b* opposing each other and traversing the slot. The capacitance value of the capacitor element 19 is capable of adjusting the tuning frequency, and is determined by the inductance value or the capacitance value of the conductive plate 13.

Accordingly, wrist type transceiver 10 is portable and can be placed on a person's wrist using wrist band 12, and is also capable of being used as a transmitter and as a receiver corresponding to a micro-wave having a predetermined frequency. The wrist type transceiver 10 having the above structure, as shown in FIG. 2, is placed on a person's wrist by engaging clasp 121 on the side of first band 12*a* with a hole 122 on the side of second band 12*b*. An antenna 14 is comprised of a conductive plate 13, having a slot 13*a* with length "L", and is narrow compared with the wavelength used. Antenna 14 functions as a slot antenna in which slot 13*a* opens in the external peripheral direction of wrist band 12. Even when the hooking position used to couple a clasp 121 with a hole 122 is changed, corresponding to different sizes of the wrist band depending on the persons who wear it, the peripheral length of slot 13*a* is not changed. The tuning frequency of antenna 14 is not shifted. Therefore, an excellent operation of an antenna can be obtained without being affected by different sizes of the wrist band depending on the persons who wear it.

Especially when hanging down on the person's wrist wearing the wrist type transceiver 10, having slot 13*a* that opens at a wide angle in the horizontal plane direction, its directional characteristic, namely its directional characteristic in the horizontal plane direction, approaches a non-directional characteristic. This is suitable for use as a portable transceiver.

Figure 4:
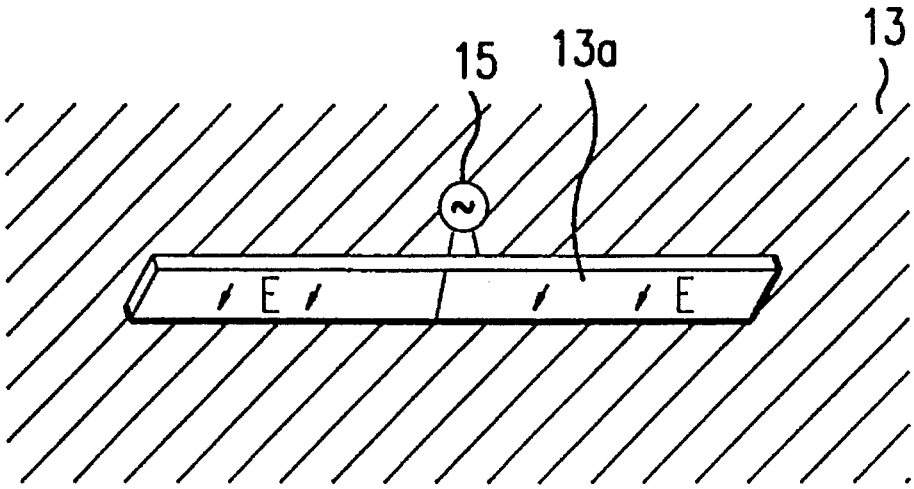
FIG. 4 is an explanatory view of the condition of feeding a signal to the antenna shown in FIG. 1.

Further, as shown in FIG. 4, when a potential is applied between a feeding circuit 15 (a high frequency amplifier circuit section 17, a transceiver circuit board) and power supplying points 131 and 132, an electric field "E" is produced at slot 13*a* as shown in FIG. 4. Accordingly, the directivity reacts mostly to a magnetic field from the longitudinal direction of slot 13*a*. When the transceiver is placed on the person's body, the electric field is weakened and the magnetic field is strengthened by the person's body. Therefore the wrist type transceiver of magnetic field detecting type in this embodiment obtains a good antenna gain.

The wrist type transceiver 10 has a desirable antenna structure for use as a wrist type transceiver. Also the wrist type transceiver 10 can be used when clasp 121 is not contacted with holes 122. Further, because antenna 24 does not include a clasp 121 as its component, it is not affected by a deterioration of the shape and the surface condition of the clasp 121 due to rust and the like. This further contributes to stable operation of the antenna. Also, because the periphery of the antenna 24 is covered completely, it is protected from the influence of static electricity and the like. This prevents the wrist type transceiver 10 from being damaged and, from mis-operating.

(Modification Of The First Embodiment)

Figure 5:
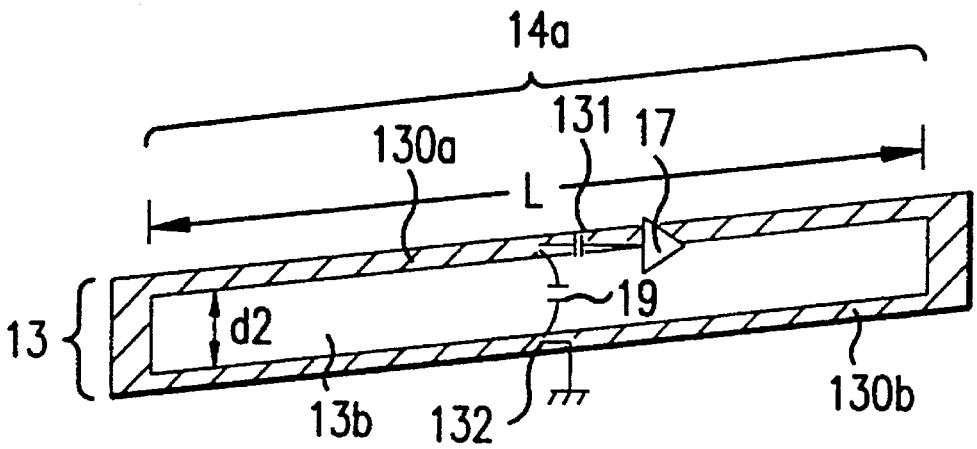
FIG. 5 is an explanatory view of the construction of an antenna for a wrist type transceiver in accordance with a modification of the first embodiment of the present invention.

According to an antenna 14 as shown in FIG. 1, FIG. 5 shows an antenna 14*a* having a conductive plate 13 whose slot 13*a* width is extended from width d1 to width d2. The remainder of the antenna according to the first embodiment as shown in FIGS. 1 and 3 is similar in structure to the antenna according to the modification of the first embodiment shown in FIG. 5. Therefore, these figures use the same numerals to refer to their corresponding sections. By setting the width of the slot 13*b* in conductive plate 13 larger comparatively, an antenna 14*a* is provided that functions as a loop antenna in that the conductive plate 13 forms a loop around its slot 13*b*.

Figure 6:
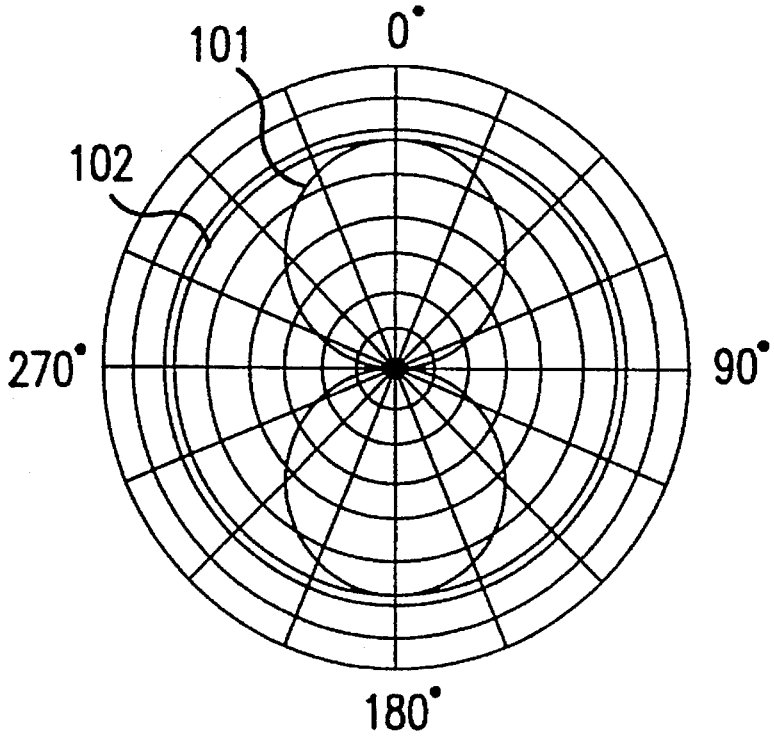
FIG. 6 is a directivity characteristic diagram in accordance with the first embodiment and its modification of the present invention.
Figure 8:
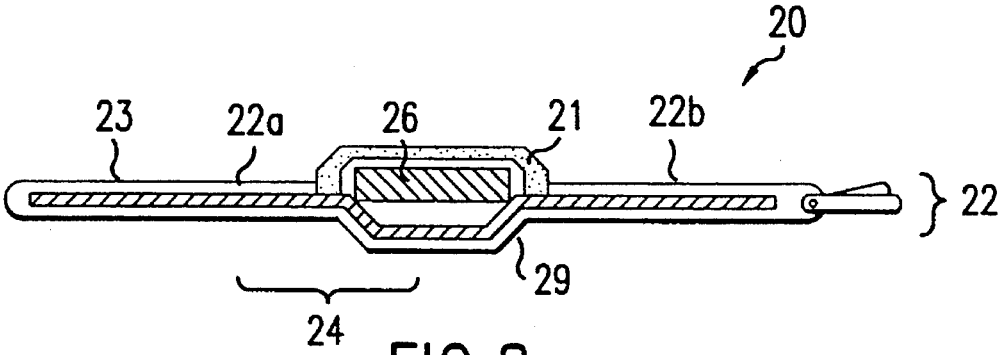
FIG. 8 is a longitudinal sectional view of the wrist type transceiver shown in FIG. 7.

Accordingly, a directivity characteristic of antenna 14*a* in the horizontal direction of the conductive plate 13 tends to be shifted from a directivity characteristic having a figure-8 shape for a slot antenna, as shown by the solid line 101 in FIG. 6, to a standard directivity characteristic of a loop antenna, as shown by the solid line 102. Therefore, in view of the first embodiment and its modification, by changing the width of slots 13*a* and 13*b* of antennas 14 and 14*a*, the directivity characteristic of the antenna can be set between the directivity characteristic of a slot antenna and that of a loop antenna.

With respect to a wrist type transceiver of the first embodiment and its modification, a conductive plate having the same function as conductive plate 13 can be provided on the side of second band 12*b*.

As to a capacitor element 19 for tuning the antenna, as an alternative to a capacitor having a non-variable capacitance, a capacitor having a variable capacitance can be used for changing (as desired) the tuning frequency of antenna 14 or 14*a*.

Also, a wrist type transceiver of the first embodiment and its modification include a wrist band 12 comprised of a first band 12*a* and a second band 12*b*, with one end portion of each band being fixed to a side of casing 11, and the other end section (free end section) of each band being provided in order to enable it to be placed on and taken off a wrist.

(The Second Embodiment)

Figure 7:
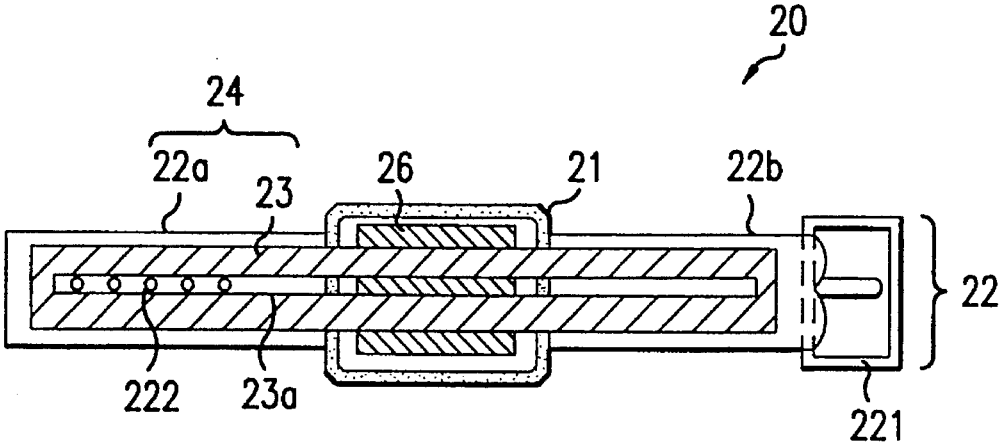
FIG. 7 is a cross-sectional view of a wrist type transceiver in accordance with a second embodiment of the present invention.

FIG. 7 is a cross-sectional view of a wrist type transceiver (an antenna apparatus for a wrist type transceiver) according to a second embodiment. FIG. 8 is a longitudinal sectional view of the wrist type transceiver of FIG. 7. As to these figures, a wrist type transceiver 20 is comprised of a casing 21 (a transceiver main body) having a transceiver circuit block 26, leather connected to the side of casing 21, and a wrist band 22 comprised of a first band 22*a* and a second band 22*b* made of a silicone resin and a urethane resin. A conductive plate 23 is formed and unitarily fixed inside of the first band 22*a* and the second band 22*b*, and crosses the inside of casing 21. An antenna 24 of wrist type transceiver 20 is comprised of the conductive plate 23, having slot 23*a* formed in its longitudinal direction. Further, the conductive plate 23 may be inserted into the first band 22*a* and the second band 22*b*, which can be sheet shaped holders seamed or adhered with each other. The conductive plate 23 is thin enough to be bent when wrist band 22 is placed on the person's wrist, and is made of material having a high conductance in order to be susceptible to less damage to antenna 24. It can be made of material with high conductance such as copper and silver. Conductive plate 23 is provided inside of the wrist band 22, its surface being covered completely with the band so as not to be easily rusted.

Further, as shown in FIG. 8, inside of casing 21, the conductive plate 23 is provided through the underside of a transceiver circuit block 26. A metal clasp 221 is provided on the end portion of a second band 22*b*. A plurality of holes 222 are formed, in order to couple with clasp 221, on the side of first band 22*a*. Accordingly, a wrist type transceiver can be held on the person's wrist with the wrist band 22; however, clasp 221 is insulated and separated from the conductive plate 23. As a result, even when the clasp 221 is coupled with a hole 222, the conductive plate 23 is not part of an electric path.

Figure 9:
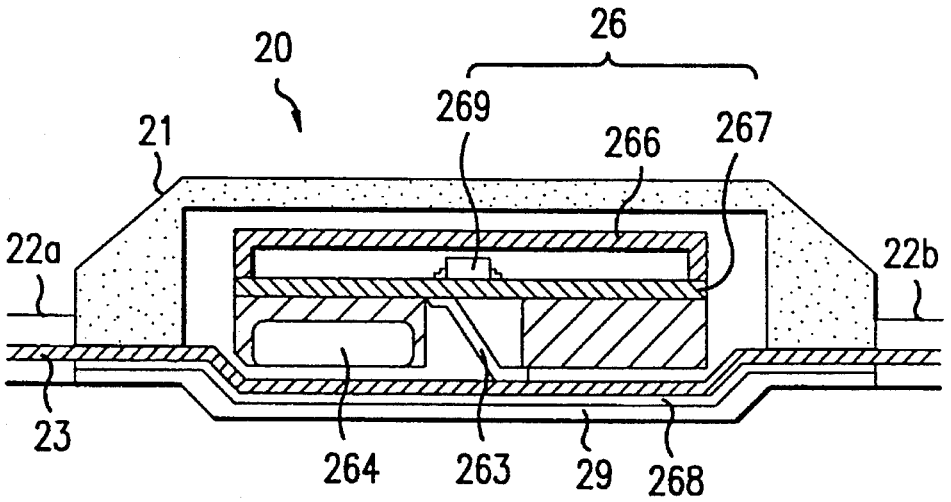
FIG. 9 is a longitudinal sectional view of the inside of a case of the wrist type transceiver shown in FIG. 7.

FIG. 9 is an enlarged longitudinal sectional view of the inside of casing 21. The inside of casing 21 is comprised of a circuit casing 266, which includes a transceiver circuit board 267, and a capacitor having a variable capacitance 269 for adjusting an antenna tuning frequency on the upper side of the circuit board 267. On the underside of circuit board 267, a battery 264 is provided and functions as a feeding portion to transceiver circuit block 26. Further, under the battery 264, a conductive plate 23 is provided on the back case 29 through an insulating plate 268. The conductive plate 23 and the transceiver circuit board 267 are wired and connected to each other by a conductive terminal 263. By shifting the connection position between the conductive terminal 263 and the conductive plate 23 to either side of first band 22*a* or second band 22*b*, an impedance can be adjusted on both sides of the conductive plate 23 and the transceiver circuit block 26.

As described for the transceiver according to the first embodiment, a variable capacitance capacitor 269 is wired and connected, and is attached to both sides of slot 23*a* in the conductive plate 23. Further, the transceiver circuit board 267, which is part of the transceiver circuit block 26, is comprised of a high frequency amplifier circuit section (not shown in the figure), which is electrically connected to either side of a slot 23*a* formed on the conductive plate 23. The other side of slot 23*a* on conductive plate 23 is grounded. This forms an unbalanced type feeding structure. The transceiver circuit block 26 also includes a circuit for timekeeping or displaying in order to display timekeeping information. A liquid-crystal panel on the upper side of casing 21 of a wrist type transceiver 20 provides this timepiece function.

Figure 10:
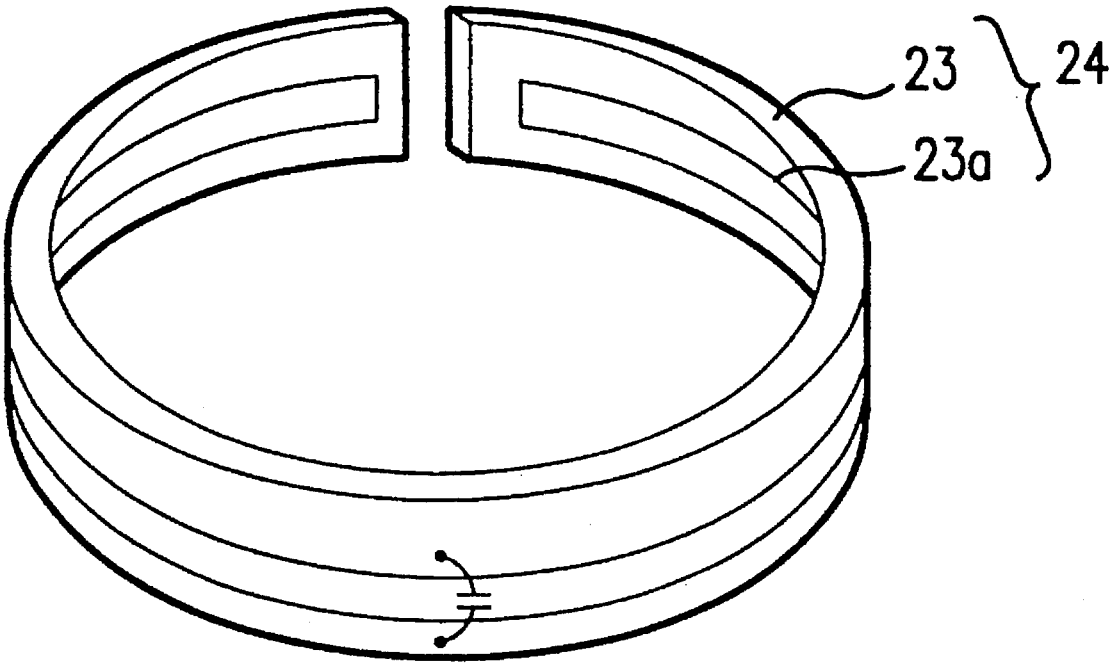
FIG. 10 is an explanatory view of a directivity of an antenna of the wrist type transceiver shown in FIG. 7, when it is put on the person's wrist.
Figure 11A:
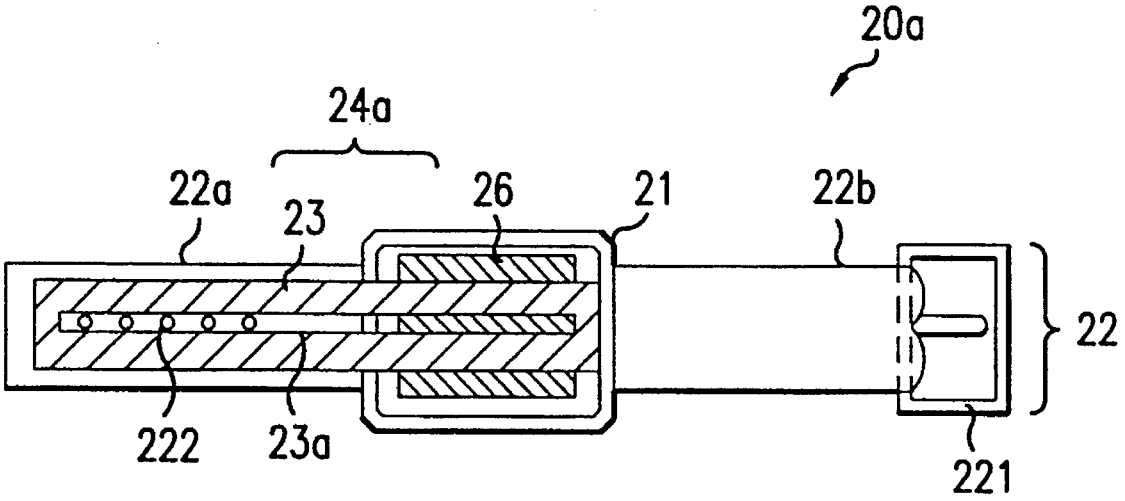
FIG. 11(*a*) is a cross-sectional view, and FIG. 11(*b*) is a longitudinal view, of a wrist type transceiver in accordance with a modification of the second embodiment of the present invention.
Figure 11B:
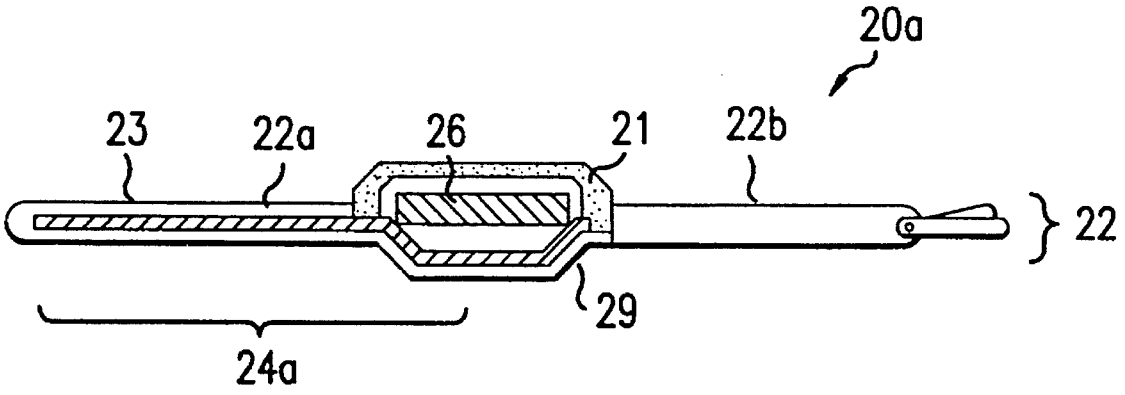

As well as the wrist type transceiver according to the first embodiment, the wrist type transceiver 20 with the above function can be used as a transmitter and a receiver placed on the person's wrist. Even when the wrist type transceiver 20 is placed on the person's wrist, antenna 24 is in the condition shown in FIG. 10, in which conductive plate 23 does not overlap itself. Therefore, its tuning frequency is not shifted, even when the hooking position for coupling together clasp 221 and hole 222 is changed.

In the wrist type transceiver 20 according to the second embodiment, a slot 23*a* is formed for almost the whole length in the longitudinal direction of a conductive plate 23. As a result of this construction, the slot 23 is open for almost the whole area in the external peripheral direction of wrist band 22. Therefore, when hanging down on the person's wrist wearing the wrist type transceiver 20, slot 23*a* is opened in all directions of a horizontal plane. As a result, its directivity characteristic is almost omnidirectional, and it is suitable for carrying because it does not provide a null point.

Also, because the wrist type transceiver functions as a magnetic field detecting type, high sensitivity can be realized when it is worn on the person's wrist.

(Modification Of The Second Embodiment)

FIG. 11(*a*) is a cross-sectional view of a wrist type transceiver (an antenna apparatus for a wrist type transceiver) according to a modification of the second embodiment of the present invention. FIG. 11(*b*) is its longitudinal sectional view. The wrist type transceiver of this embodiment has almost the same structure as the wrist type transceiver shown in FIG. 7 and FIG. 8; therefore the corresponding portions are shown using the same reference numerals.

As to these figures, the wrist type transceiver of this embodiment is comprised of a casing 21 (a transceiver main body) having a transceiver circuit block 26, leather connected to the side of casing 21, and a wrist band 22 comprised of a first band 22*a* and a second band 22*b* made of a silicone resin and a urethane resin.

An antenna 24*a* of the wrist type transceiver 20*a* is comprised of a conductive plate 23, which is unitarily fixed on the first band 22*a*, with its slot 23*a* formed in the longitudinal direction. As shown in FIG. 11(*b*), one end of the conductive plate 23 is positioned between a transceiver circuit block 26 and the back case 29. Further, the conductive plate 23 and the transceiver circuit block 26 are wired and connected to each other. The transceiver circuit block 26 includes a variable capacitance capacitor (not shown in the figure), which is attached between both sides of the slot 23*a* in the conductive plate 23 for adjusting the tuning frequency of the antenna.

The wrist type transceiver 20*a* can be placed on the person's wrist with wrist band 22 by providing a metal clasp 221 on the end portion of the second band 22*b*, and by forming a plurality of holes 222, capable of coupling together with clasp 221 on the side of the first band 22*a*.

When worn on the person's wrist, the wrist type transceiver 20*a* having the above structure has the same effect as the wrist type transceiver according to the second embodiment. Because the length of the conductive plate 23 is shorter than that of the second embodiment, the antenna gain is reduced, and its use is limited. Reliability thereof, however, is upgraded due to the low cost and the smaller number of parts required with this simplified construction.

(The Third Embodiment)

Figure 12:
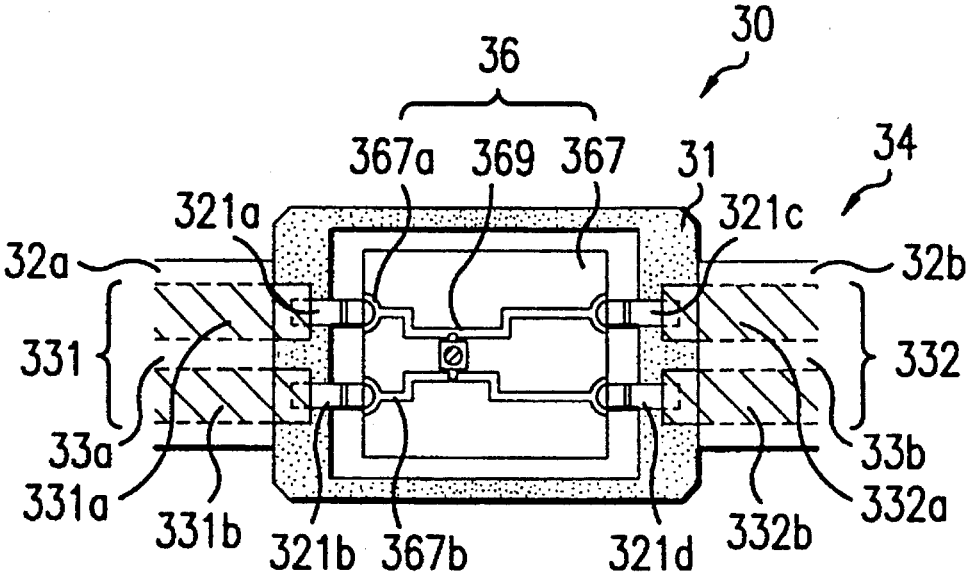
FIG. 12 is a cross-sectional view of the construction of the periphery of a casing of a wrist type transceiver in accordance with a third embodiment of the present invention.
Figure 13:
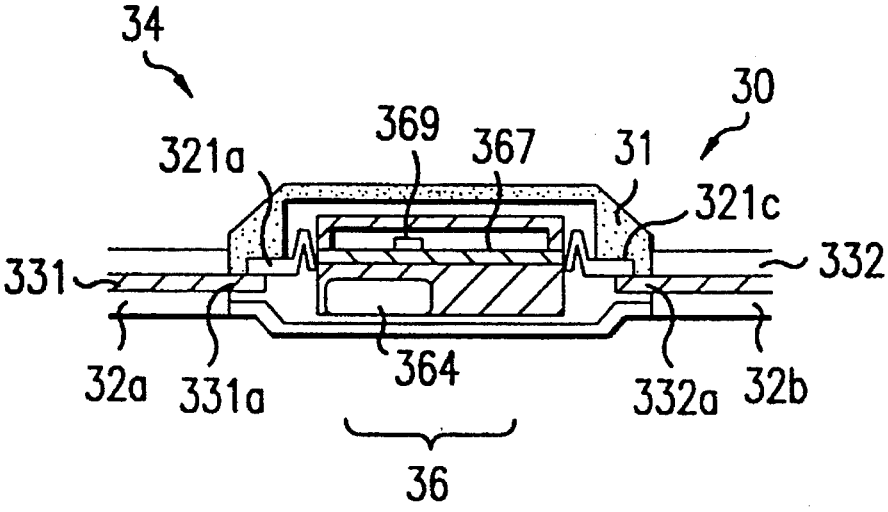
FIG. 13 is a longitudinal sectional view of the construction of the periphery of the casing of the wrist type transceiver shown in FIG. 12.

FIG. 12 is a cross-sectional view of the construction of the periphery of a case of a wrist type transceiver in accordance with a third embodiment of the present invention. FIG. 13 is its longitudinal sectional view. A wrist type band and the like, which is not shown in FIGS. 12 and 13, can have the same structure as the wrist type transceiver according to the second embodiment. A wrist type transceiver 30 of this embodiment is comprised of a casing 31 (a transceiver main body) having a transceiver circuit block 36, and a wrist band comprised of a first band 32*a* and a second band 32*b* made of resin and the like connected to the side of a casing 31. A first conductive plate 331 and a second conductive plate 332 are unitarily formed and fixed respectively on the first band 32*a* and the second band 32*b*.

An antenna 34 of the wrist type transceiver 30 is comprised of the first conductive plate 331 and the second conductive plate 332, each having slots 33*a* and 33*b*, which are formed on both sides of the first conductive plate 331 and the second conductive plate 332 in the longitudinal direction. The slots 33*a* and 33*b* are formed from the edge sections at the side of casing 31, and extends in the longitudinal direction of the first conductive plate 331 and the second conductive plate 332. These slots 33*a* and 33*b* have an open end located at the edge section adjacent to the side of casing 31.

Therefore, the first conductive plate 331 is divided into one end section 331*a* and another end section 331*b* by the slot 33*a*. The second conductive plate 332 is divided into one end section 332*a* and another end section 332*b* by the slot 33*b*. One end section 331*a* of the first conductive plate 331 and one end section 332*a* of the second conductive plate 332 are wired and connected to each other inside casing 31. The other end section 331*b* of the first conductive plate 331 and the other end section 332*b* of the second conductive plate 332, also are wired and connected to each other inside casing 31.

Accordingly, casing 31 provides conductive terminals 321*a*, 321*b*, 321*c* and 321*d* unitarily formed on both sides of the casing 31 respectively. Each end section of these conductive terminals is electrically connected by a solder joint to one end section 331*a* and the other end section 331*b* of the first conductive plate 331, and also to one end section 332*a* and the other end section 332*b* of the second conductive plate 332. The conductive terminals 321*a* and 321*c* also are electrically connected to each other through a circuit pattern 367*a* on a transceiver circuit board 367 in transceiver circuit block 36. The conductive terminals 321*b* and 321*d* are electrically connected to each other through the other side circuit pattern 367*b* on transceiver circuit board 367.

As shown in FIG. 13, the provision of bending portions on the conducting and contacting side of the transceiver circuit block 36, enables the conductive terminals 321*a*, 321*b*, 321*c*, 321*d* to conduct and connect to the circuit pattern 367*a* or to the other circuit pattern 367*b* by using the spring characteristic of the bending portions. Thus, its vibrations are not propagated to the inside of the casing 31. Further, a variable capacitance capacitor 369, for adjusting an antenna tuning frequency, is attached between the circuit pattern 367*a* and the other circuit pattern 367*b*. A battery 364 is located under the transceiver circuit board 367.

The above mentioned wrist type transceiver 30 obtains the following effects in addition to those obtained by the wrist type transceiver according to the second embodiment. The first conductive plate 331 and the second conductive plate 332 are formed to the side of the first band 32*a* and the second band 32*b* respectively, and are electrically connected to the side of casing 31 through the conductive terminals 321*a*, 321*b*, 321*c* and 321*d*. Therefore, these conductive plates can be removed easily from the casing side. Accordingly, after the wrist type transceiver 30 has been repeatedly placed on and off the person's wrist, possibly causing damage to the side of the wrist band, it is possible to exchange the wrist band by easily removing it from the casing 31. Further, each part of the wrist type transceiver 30 can be produced readily, therefore realizing mass production.

(The Fourth Embodiment)

Figure 14:
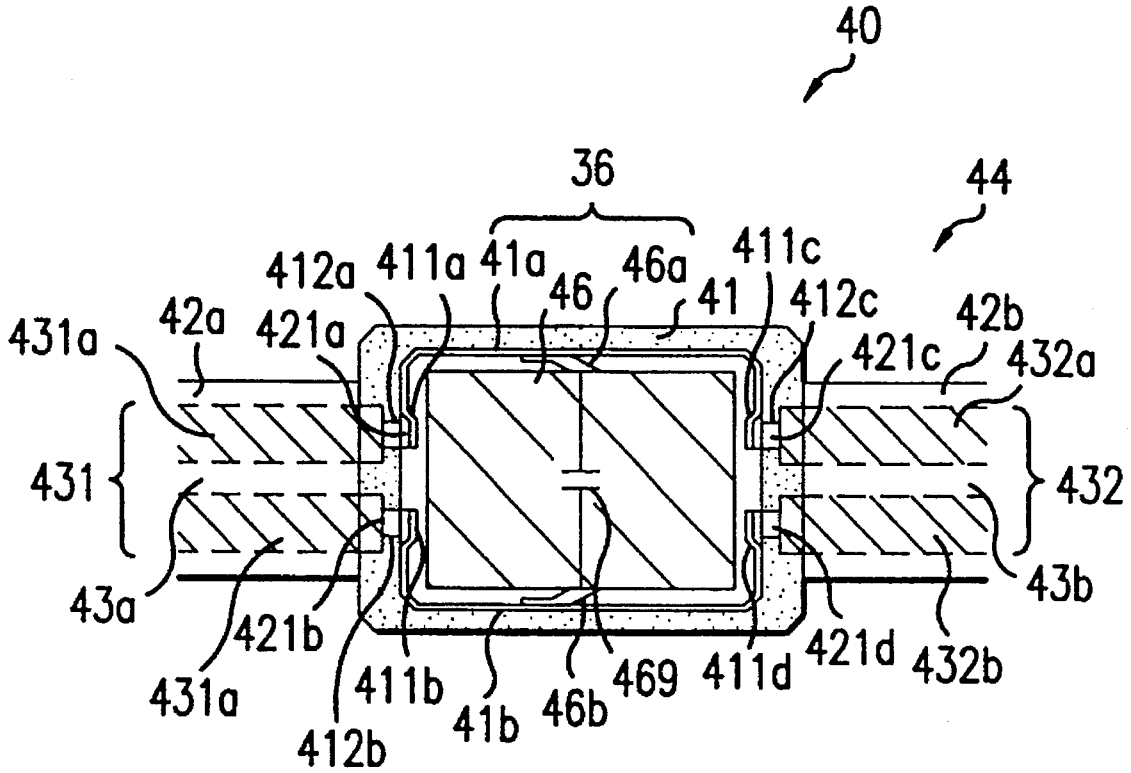
FIG. 14 is a cross-sectional view of the construction of the periphery of a casing of a wrist type transceiver in accordance with a fourth embodiment of the present invention.
Figure 15:
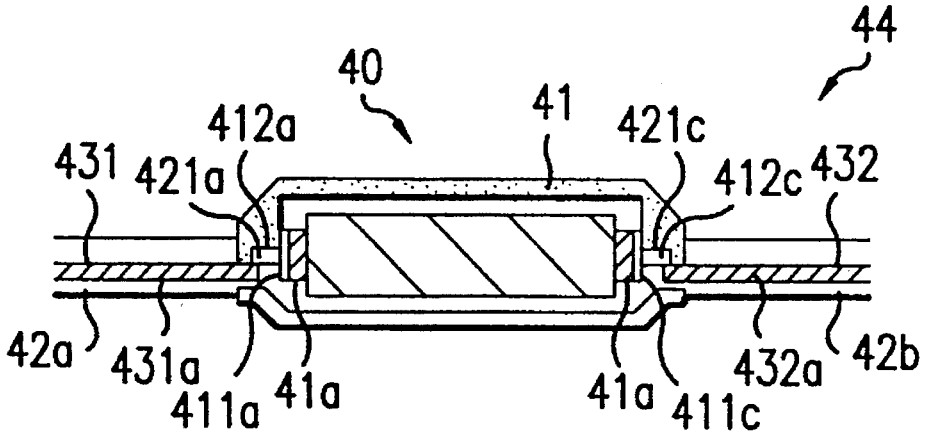
FIG. 15 is a longitudinal sectional view of the construction of the periphery of the casing of the wrist type transceiver shown in FIG. 14.

FIG. 14 is a cross-sectional view of the construction of a casing of a wrist type transceiver (an antenna apparatus for wrist type transceiver) in accordance with a fourth embodiment of the present invention. FIG. 15 is its longitudinal sectional view. As to the wrist type transceiver of this embodiment, a wrist type band and the like, which is not shown in FIGS. 14 and 15, has the same structure as the wrist type transceiver according to the second embodiment. A wrist type transceiver 40 of this embodiment is comprised of a casing 41 (a transceiver main body) having a transceiver circuit block 46, and a wrist band comprised of a first band 42*a* and a second band 42*b* made of leather and the like connected to the side of casing 41. A first conductive plate 431 and a second conductive plate 432 are unitarily formed and fixed respectively on the first band 42*a* and the second band 42*b*. An antenna 44 of the wrist type transceiver 40 is comprised of the first conductive plate 431 and the second conductive plate 432, having slots 43*a* and 43*b* formed on both sides of the first conductive plate 431 and the second conductive plate 432 that extend in the longitudinal direction. Slots 43*a* and 43*b* are formed from the edge sections at the side of casing 41, and extend in the longitudinal direction of the first conductive plate 431 and the second conductive plate 432. Slots 43*a* and 43*b* have open ends at the edge section of the side of casing 41.

Accordingly, the first conductive plate 431 is divided into one end section 431*a* and another end section 431*b* by the slot 43*a*. The second conductive plate 432 is divided into one end section 432*a* and another end section 432*b* by the slot 43*b*. One end section 431*a* of the first conductive plate 431 and one end section 432*a* of the second conductive plate 432 are wired and connected to each other inside casing 41. The other end section 431*b* of the first conductive plate 431 and the other end section 432*b* of the second conductive plate 432 are also wired and connected to each other inside casing 41. Therefore, end sections 431*a*, 431*b*, 432*a* and 432*b* are fixed to conductive terminals 421*a*, 421*b*, 421*c* and 421*d* respectively. Two wiring sections 41*a* and 41*b* are formed along the internal periphery of the casing 41. Conductive terminals 421*a* and 421*c* are electrically connected to the wiring section 41*a*. Conductive terminals 421*b* and 421*d* are electrically connected to the wiring section 41*b*. The conductive terminals 421*a*, 421*b*, 421*c* and 421*d* are connected to the wiring sections 41*a* and 41*b*, whose end portions 411*a*, 411*b*, 411*c* and 411*d* are positioned to correspond to the hole that receives each terminal, namely holes 412*a*, 412*b*, 412*c* and 412*d* in casing 41. Therefore, when the conductive terminals 421*a*, 421*b*, 421*c* and 421*d* are pushed into the holes 412*a*, 412*b*, 412*c* and 412*d* from the outside of casing 41, each end of the conductive terminals deform and contact with the end portions 411*a*, 411*b*, 411*c* and 411*d* of the wiring sections 41*a*, 41*b*. Accordingly, the conductive terminals 421*a*, 421*b*, 421*c* and 421*d* are connected completely to the wiring sections 41*a* and 41*b* by the force produced when these deformed end portions return to the original position.

A circuit block 46 provided in casing 41 includes a variable capacitance capacitor 469 for adjusting an antenna tuning frequency. This is electrically connected to the wiring sections 41*a*, 41*b* through the conductive terminals 46*a* and 46*b*, which have spring characteristics.

The above mentioned wrist type transceiver 40 obtains the same effects as the wrist type transceiver according to the third embodiment. The conductive terminals 421*a*, 421*b*, 421*c* and 421*d*, which are fixed to the first conductive plate 431 and the second conductive plate 432, can become damaged after casing 441 is repeatedly taken on and off the person's wrist. It is, however, possible to exchange the wrist band easily by removing it from the casing 41. Each part of the wrist type transceiver 40 can be produced readily, therefore mass production is realized.

Further, the wiring sections 41*a* and 41*b*, which contact the first conductive plate 431 with the second conductive plate 432, are formed in the internal peripheral surface at the side of the casing 41. Therefore, when these wiring sections 41*a*, 41*b* are wired and connected to a transceiver circuit block 46, it is not necessary to extend the height of the side of casing 41. Therefore, the thickness of the wrist type transceiver 40 becomes thin, and it is suitable for portable use. Further, without changing the height of the casing 41, it is possible to supply a component having a watch function in the thickness direction of the casing 41. This increases the freedom of its design.

(The Fifth Embodiment)

Figure 16:
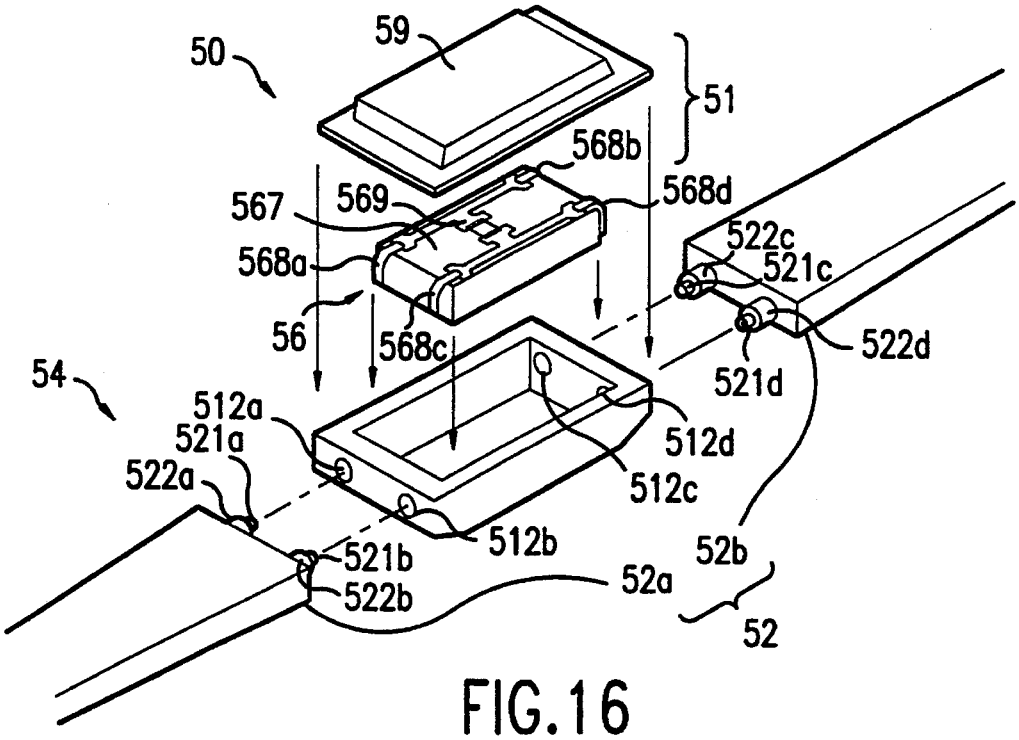
FIG. 16 is an exploded perspective view from a rear face of the periphery of a casing of a wrist type transceiver in accordance with a fifth embodiment of the present invention.
Figure 17A:
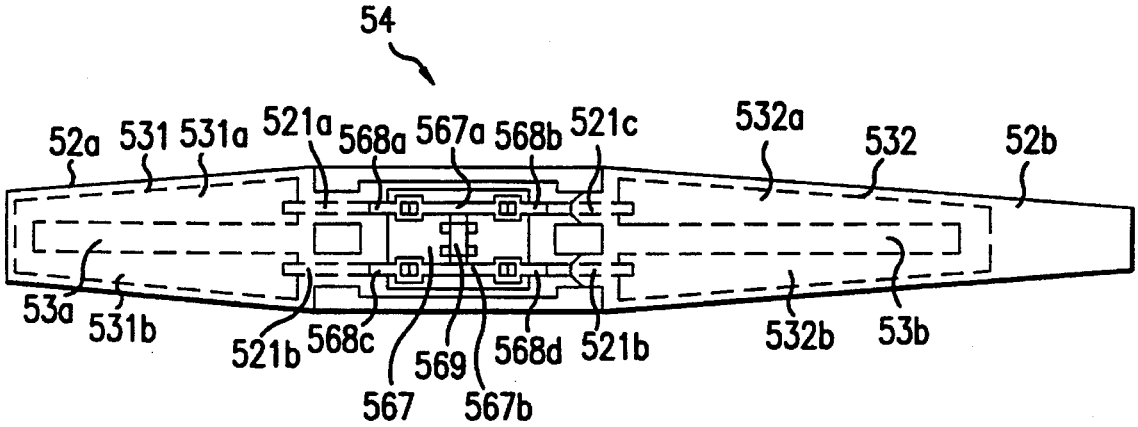
FIG. 17(*a*) is a cross-sectional view, and FIG. 17(*b*) is a longitudinal sectional view, of the wrist type transceiver shown in FIG. 16.
Figure 17B:
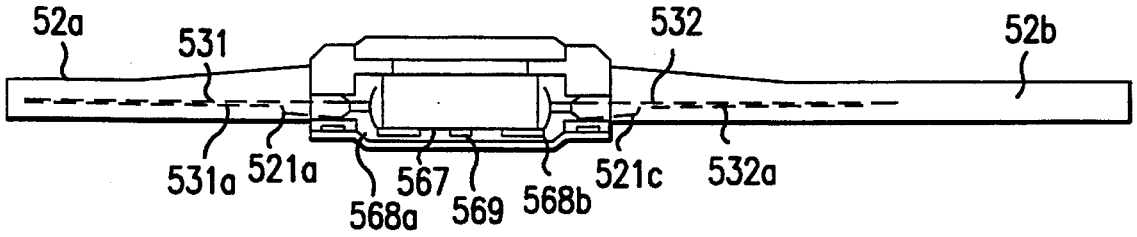

FIG. 16 is an exploded perspective view from the rear face of a wrist type transceiver (an antenna apparatus for wrist type transceiver) in accordance with a fifth embodiment of the present invention. FIG. 17(*a*) is its cross-sectional view, and FIG. 17(*b*) is its longitudinal view. A wrist type transceiver 50 of this embodiment is comprised of a casing 51 (a transceiver main body) having a transceiver circuit block 56, and a wrist band 52 comprised of a first band 52*a* and a second band 52*b* made of leather and the like, connected to the side of casing 51. A first conductive plate 531 and a second conductive plate 532 are unitarily formed and fixed respectively on the first band 52*a* and the second band 52*b*.

An antenna 54 of the wrist type transceiver 50 is comprised of the first conductive plate 531 and the second conductive plate 532 having slots 53*a* and 53*b*, formed on both sides of the first conductive plate 531 and the second conductive plate 532 and extending in the longitudinal direction. The first conductive plate 531 and the second conductive plate 532 have different widths, respectively in their longitudinal directions. A maximum width is provided at each portion in order for its antenna resistance to become small. The slots 53*a* and 53*b* are formed from the edge sections at the side of casing 51, and extend in the longitudinal direction of the first conductive plate 531 and the second conductive plate 532. These slots 53*a* and 53*b* also have open ends at the edge section at the side of casing 51.

Accordingly, the first conductive plate 531 is divided into one end section 531*a* and another end section 531*b* by the slot 53*a*. The second conductive plate 532 also is divided into one end section 532*a* and another end section 532*b* by the slot 53*b*. One end section 531*a* of the first conductive plate 531 and one end section 532*a* of the second conductive plate 532 are wired and connected to each other through casing 51. The other end section 531*b* of the first conductive plate 531 and the other end section 532*b* of the second conductive plate 532 are wired and connected to each other through casing 51. Therefore, end sections 531*a*, 531*b*, 532*a*, and 532*b* are fixed by spot welding to conductive terminals 521*a*, 521*b*, 521*c* and 521*d* respectively, whose tip sides are projected over the overhanging sections 522*a*, 522*b*, 522*c* and 522*d* of the first and second bands.

In the casing 51, on a transceiver circuit board 567 on the transceiver circuit block 56, terminal strips 568*a* and 568*b* are fixed on the end portion of the circuit pattern 567*a* by solder and the like. Terminal strips 568*c* and 568*d* are also fixed on the end portion of the other circuit pattern 567*b*. Each terminal strip 568*a*, 568*b*, 568*c* and 568*d* has a spring characteristic produced by bending itself at a plurality of points. It also is disposed to correspond to the insert holes 512*a*, 512*b*, 512*c* and 512*d* in casing 56. When overhanging sections 522*a*, 522*b*, 522*c* and 522*d* of the first and second bands 52*a* and 52*b* are inserted in the holes 512*a*, 512*b*, 512*c* and 512*d* of the casing 56, with conductive terminals 521*a*, 521*b*, 521*c* and 521*d* electrically connected to the terminal strips 568*a*, 568*b*, 568*c* and 568*d*, one end section 531*a* of the first conductive plate 531 is wired and connected to one end section 532*a* of the second conductive plate 532. The other end section 531*b* of the first conductive plate 531 also is wired and connected to the other end section 532*b* of the second conductive plate 532. The first band 52*a* and the second band 52*b* are fixed to a side of the casing 51, respectively, and are capable of separating from the casing. The holes 512*a*, 512*b*, 512*c* and 512*d* in casing 51 are sealed by the overhanging sections 522*a*, 522*b*, 522*c* and 522*d* of the first band 52*a* and the second band 52*b*. A back cap 59 is mounted on the back side of the casing 51 in order to obtain its waterproof characteristics. As mentioned above, the first and second bands 52*a*, 52*b* are fixed to the side of a casing 51, which is a well known structure such as a timepiece structure, in which a timepiece is fixed to the wrist band.

On a transceiver circuit board 567, a variable capacitance capacitor 569 for adjusting an antenna tuning frequency is mounted between one side circuit pattern 567*a* and the other side circuit pattern 567*b*, and thus is attached between both sides of a slot 53 in the electric circuit.

The wrist type transceiver 50 of this embodiment also can be used for a timepiece, with a liquid crystal display panel (not shown) provided on the surface of the casing, and with a timekeeping circuit and a circuit for driving the display panel (not shown) provided in circuit block 56.

Figure 18:
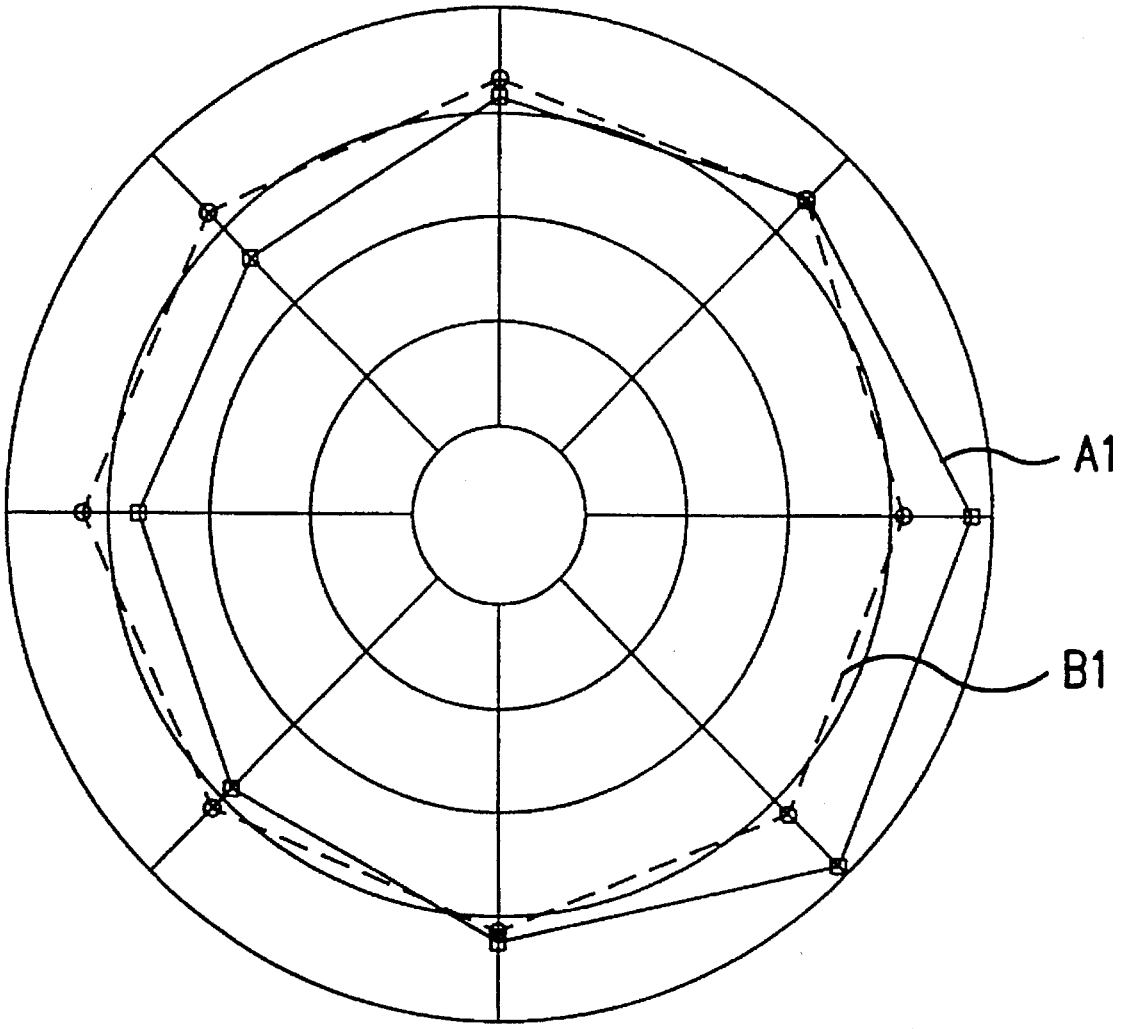
FIG. 18 is a directivity characteristic diagram in the horizontal plane direction of a wrist type transceiver in the condition of hanging down from a person's wrist wearing the wrist type transceiver shown in FIG. 16.

According to the wrist type transceiver with the above mentioned structure, even when it is placed on the person's body, without overlapping the first conductive plate 531 and the second conductive plate with each other in an antenna 54, a peripheral length of a slot 53*a* is constant, and is not affected by different sizes of a wrist band 52. Therefore, its tuning frequency does not shift, and a high antenna gain can be obtained, without depending on the persons who wear it. Further, when hanging down the person's wrist who wears it, slots 53*a*, 53*b* are open in almost all directions of a horizontal plane. Therefore, antenna gain to a vertically polarized wave having a frequency of about 284 MHz is a non-directional characteristic. Measured results are shown by the solid line A1 of FIG. 18. Also a dotted line B1 shows its characteristic when the wrist type transceiver 50 is provided individually, in the same position as when the transceiver is hanging down on the person's wrist. Comparing a solid line A1 with dotted line B1, which are nondirectional characteristics respectively, A1 has a higher antenna gain than B1. Since the wrist type transceiver 50 of this embodiment functions as the magnetic field detecting type, a high sensitivity can be realized when it is placed on the person's wrist.

Figure 19:
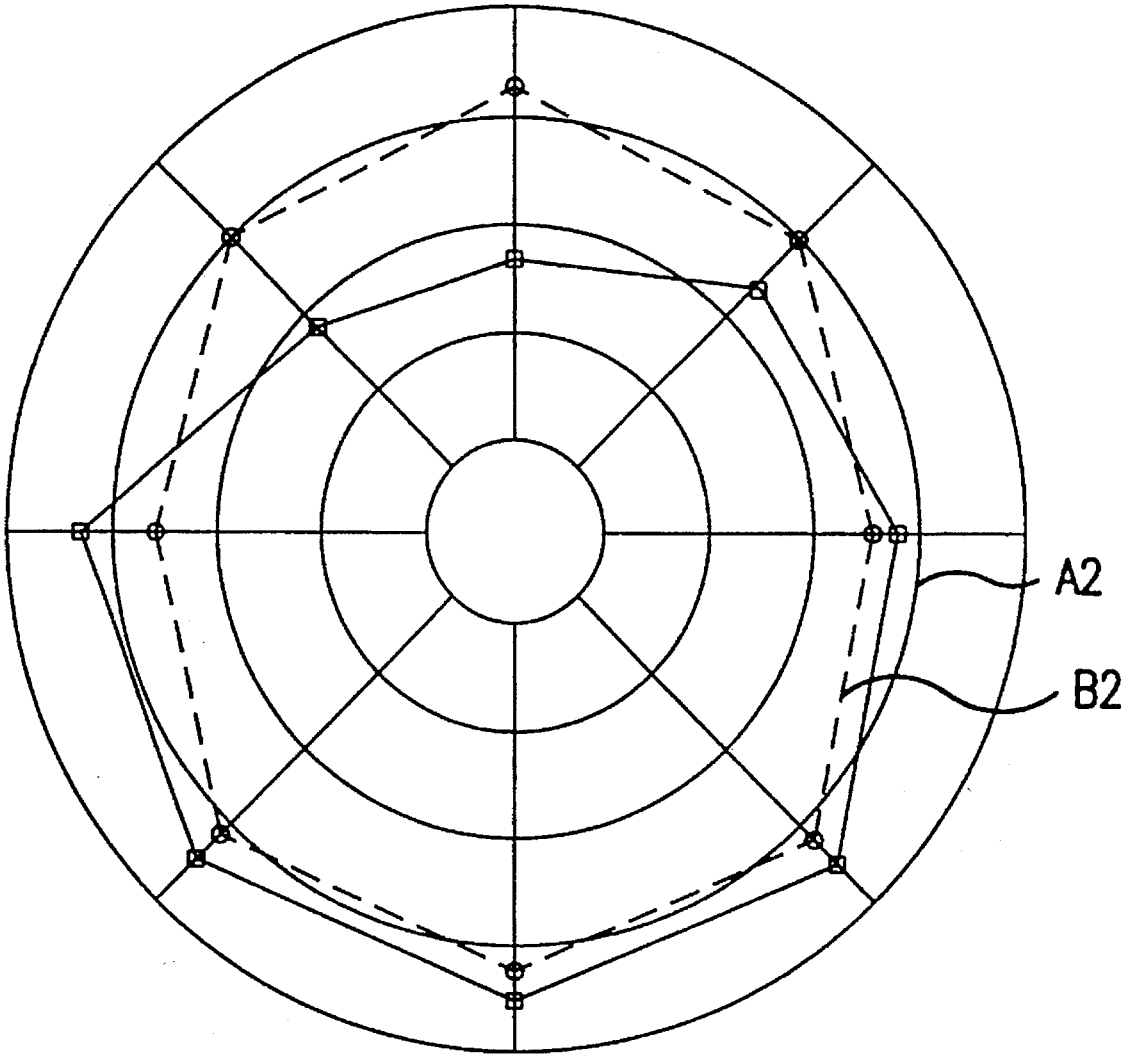
FIG. 19 is a directivity characteristic diagram in the horizontal plane direction of a wrist type transceiver in the condition of bending a person's wrist wearing the wrist type transceiver shown in FIG. 16, and holding the transceiver horizontally in front of the chest.

Further, when hanging down a different person's wrist, or when provided individually under the same condition, it has an antenna gain to a vertically polarized wave having a frequency of 284 MHz, and high antenna gain and non-directional characteristics, without greatly changing its directional characteristics or antenna gain. When held horizontally in front of the chest of a person wearing the transceiver, or providing it individually under the same condition, it has an antenna gain to a vertically polarized wave having a frequency of 284 MHz, high antenna gain and non-directional characteristics, as shown by the solid line A1 (worn on the person's wrist) and a dotted line B1 (provided individually) of FIG. 19.

The above mentioned wrist type transceiver 50 obtains the same effects as the wrist type transceiver according to the third and the fourth embodiments. The first conductive plate 531 and the second conductive plate 532 are electrically connected to a casing 51 through the conductive terminals 521*a*, 521*b*, 521*c* and 521*d*, resulting in a wrist band 52 that can be removed easily from a side of casing 51. Accordingly, when the band becomes damaged from being repeatedly taken on and off, it is possible to exchange the wrist band by removing it easily from the casing 51. Further, each part of the wrist type transceiver 50 can be produced readily, therefore mass production is realized.

(The Sixth Embodiment)

Figure 20:
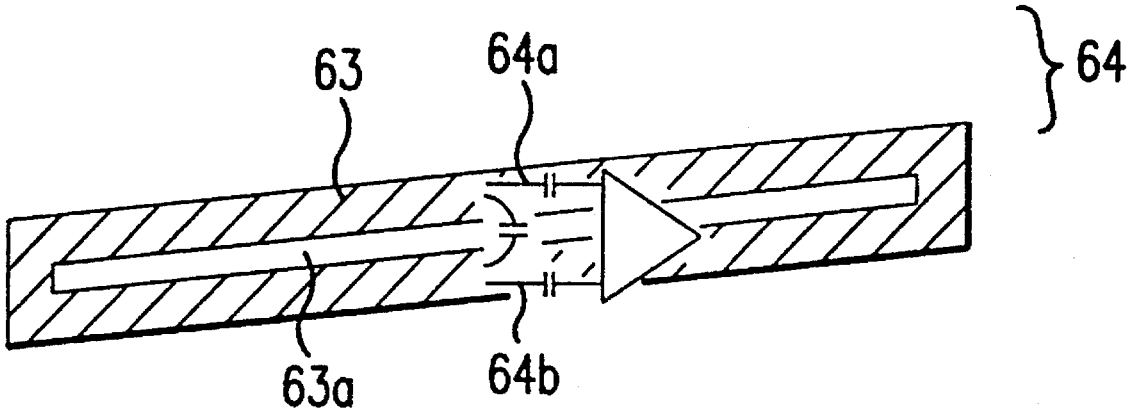
FIG. 20 is a view of the construction of an antenna for a wrist type transceiver in accordance with a sixth embodiment of the present invention.

FIG. 20 is a view of an antenna for a wrist type transceiver (an antenna apparatus for wrist type transceiver) in accordance with a sixth embodiment of the present invention. The wrist type transceiver of this embodiment has the same structure as the wrist type transceiver according to the first and the fifth embodiments. It is different in the structure for supplying a signal to a conductive plate, as described in detail below.

FIG. 20 shows the structure for supplying a signal to an antenna 64 of the wrist type transceiver, in which feeding points 64*a*, 64*b* are mounted on both sides of a slot 63*a* of a conductive plate 63 in order that its electric characteristic becomes equivalent. Namely, the transceiver circuit becomes a balanced type feeding circuit. Accordingly, the balanced type feeding and the unbalanced type feeding can be adopted as the structure of the circuit for the wrist type transceiver.

(The Seventh Embodiment)

Figure 21:
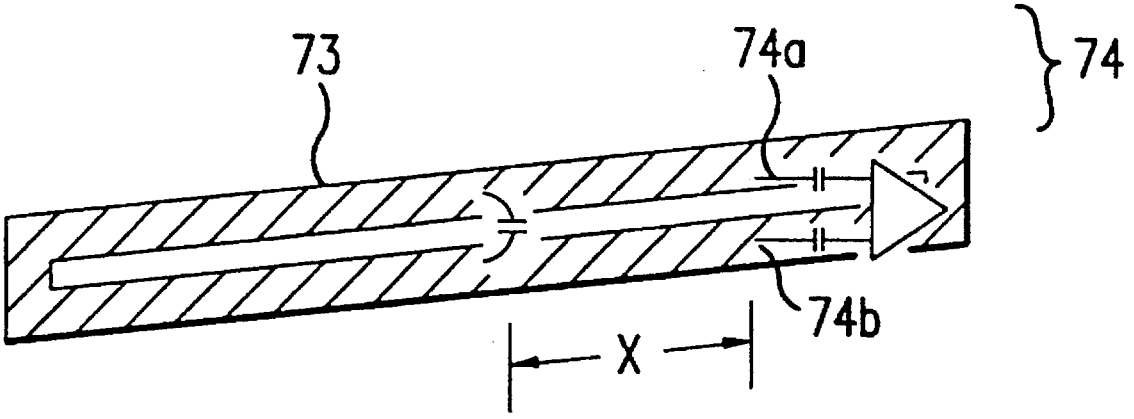
FIG. 21 is a view of the construction of an antenna for a wrist type transceiver in accordance with a seventh embodiment of the present invention.

FIG. 21 is a view of an antenna for a wrist type transceiver (an antenna apparatus for wrist type transceiver) in accordance with a seventh embodiment of the present invention. The wrist type transceiver of this embodiment has the same structure as the wrist type transceiver according to the first and the fifth embodiments. It is different in the structure for supplying a signal to a conductive plate, as described in detail below.

FIG. 21 shows the structure for an antenna 74 of the wrist type transceiver, in which, to correspond to an impedance value of the conductive plate 73, power is supplied by shifting the feeding positions 74*a* and 74*b* from the center to the end portion of the conductive plate 73 (i.e. by shifting X distance). Therefore, it is possible to adjust the impedance between the antenna 74 and the transceiver circuit, without changing the construction of the conductive plate or of the transceiver circuit.

(The Eighth Embodiment)

Figure 22A:
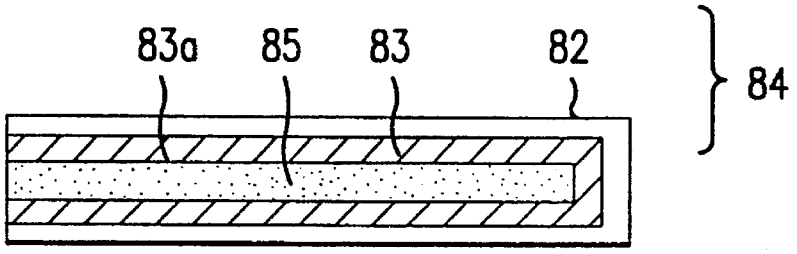
FIG. 22(*a*) is a cross-sectional view, and FIG. 22(*b*) is a longitudinal sectional view, of the construction of an antenna for a wrist type transceiver in accordance with an eighth embodiment of the present invention.
Figure 22B:
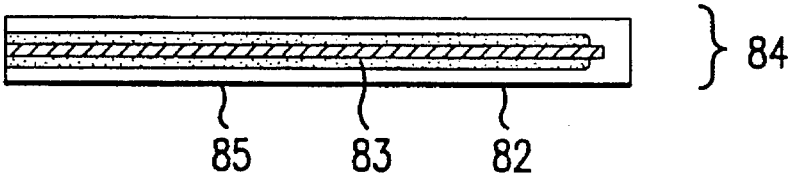

FIG. 22(*a*) is a cross-sectional view, and FIG. 22(*b*) is a longitudinal sectional view, of an antenna for a wrist type transceiver (an antenna apparatus for wrist type transceiver) in accordance with an eighth embodiment of the present invention. The wrist type transceiver of this embodiment has the same structure as the wrist type transceiver according to the first and the fifth embodiments. It is different in the structure used for the inside of the slot of the conductive plate, as described in detail below.

An antenna 84 of this embodiment has a conductive plate 83, whose slot 83*a* is formed to extend in the longitudinal direction of the conductive plate. The inside of the slot is filled with a dielectric layer 85 such as a silicone or a ceramic material, with the external peripheral side of the slot being covered by a band 82 having insulating characteristics. The wavelength of an electromagnetic wave which propagates inside of the dielectric layer 85 of the antenna 84, is shown by the following formula.

$$\lambda' = \lambda/(\epsilon^{1/2})$$

$\lambda'$: Wavelength in Dielectric $\lambda$: Wavelength in Air $\epsilon$: Dielectric Constant of Dielectric Accordingly, the electromagnetic wavelength, which propagates inside of the dielectric layer 85, is shortened as the dielectric constant of the dielectric layer 85 becomes greater. In this case, the same antenna gain can be obtained as would be possible with a structure in which a slot 83*a* of the conductive plate 83 (an antenna unit 84) is longer. Therefore, good antenna gain can be obtained to an electromagnetic wave having a long wavelength without extending the peripheral length of the slot 83*a*. The shortened antenna 84 can be used in order to obtain good antenna gain to an electromagnetic wave having the same wavelength. Therefore, it is possible to realize a miniaturized antenna unit. Only the inside of the slot is filled with a dielectric layer 85; however, such a structure in which the whole conductive plate 83 is covered with the dielectric layer 85 also can be adopted.

(The Ninth Embodiment)

Figure 23:
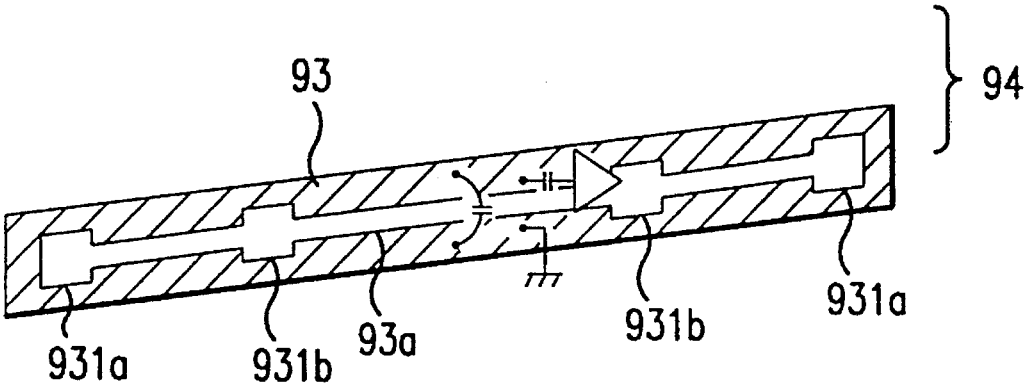
FIG. 23 is a view of the construction of an antenna for a wrist type transceiver in accordance with a ninth embodiment of the present invention.
Figure 24:
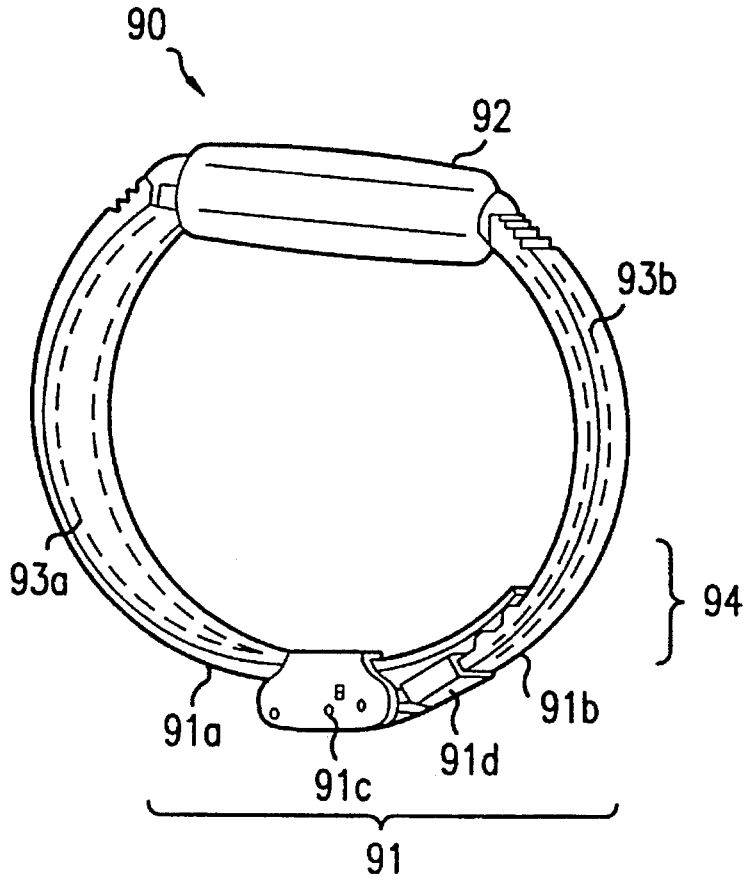
FIG.24 PRIOR ART
FIG. 24 is a view of the construction of an antenna for a conventional wrist type transceiver.
Figure 25:
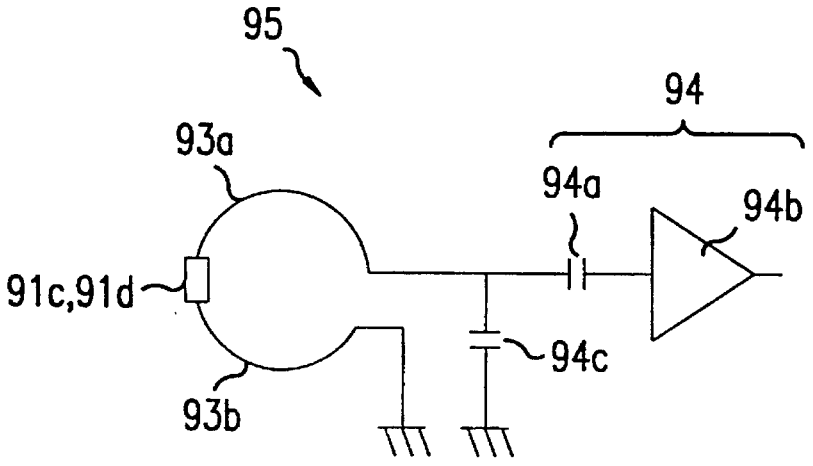
FIG.25 PRIOR ART
FIG. 25 is an equivalence circuit diagram of the wrist type transceiver shown in FIG. 24.
Figure 3:
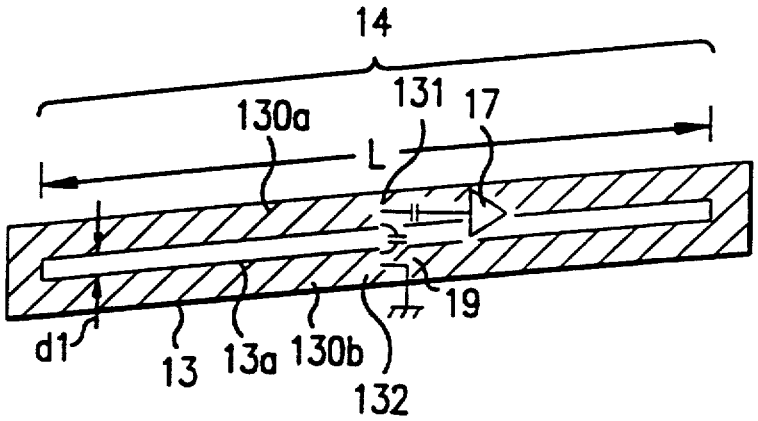
Figure 4:
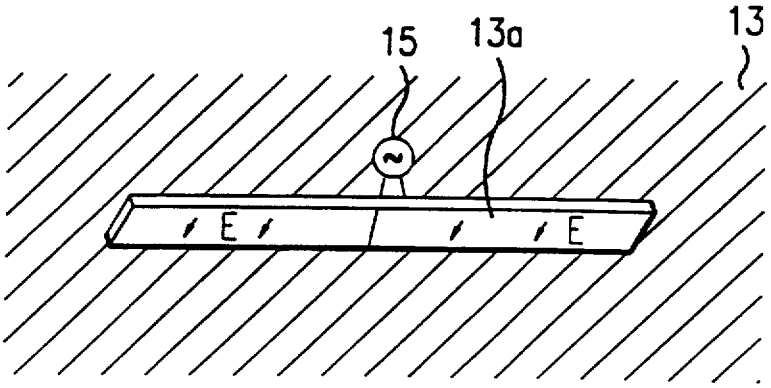
Figure 5:
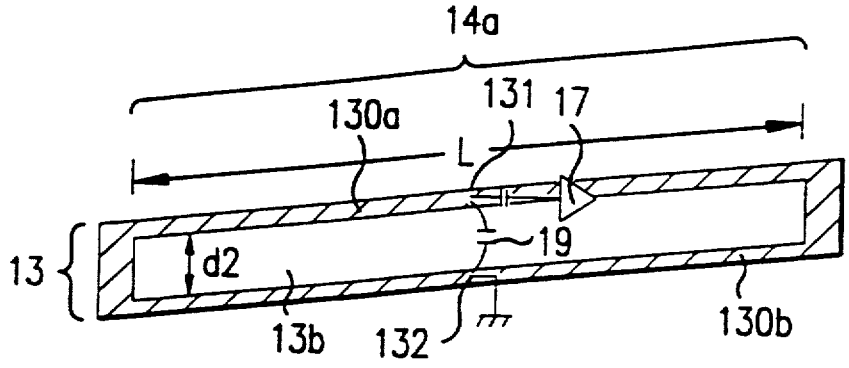
Figure 6:
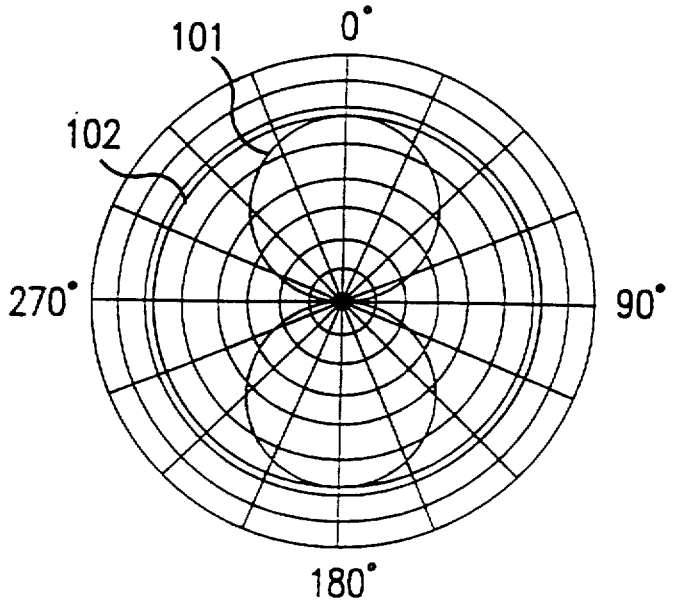
Figure 7:
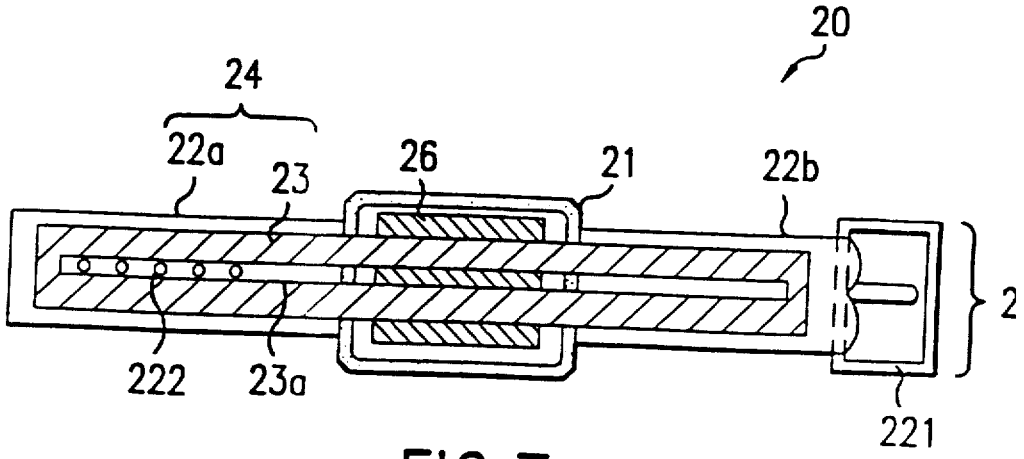
Figure 8:
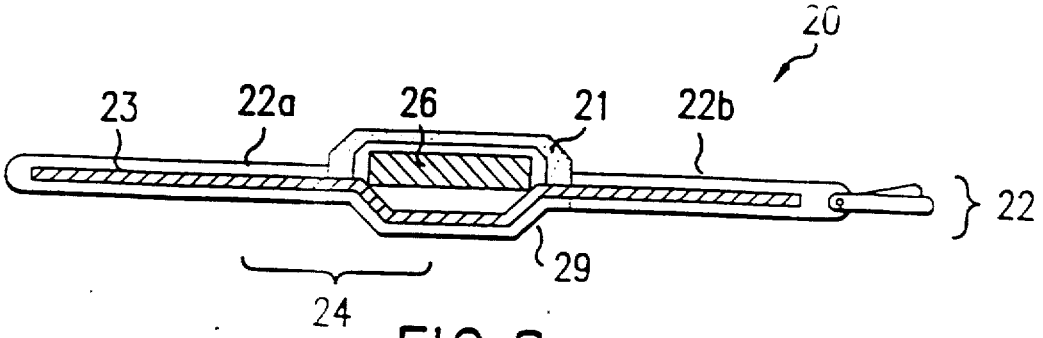
Figure 9:
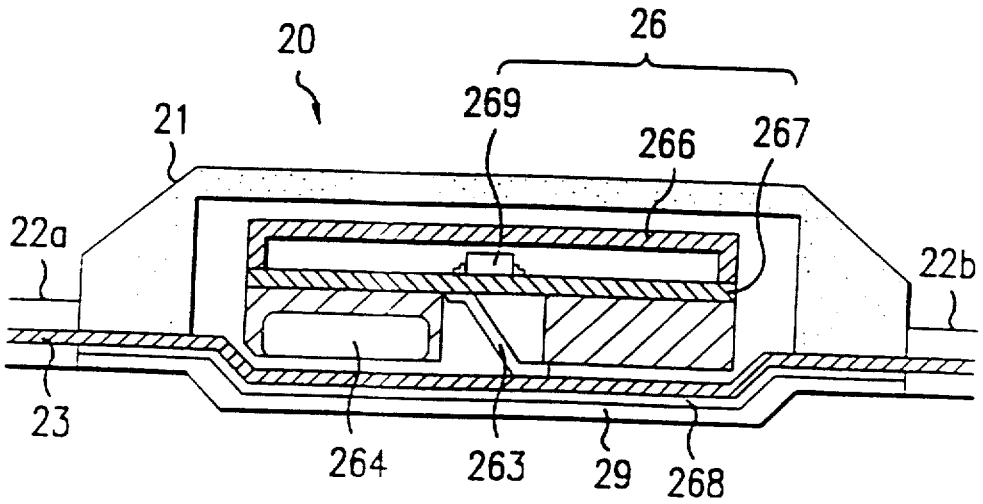
Figure 11A:
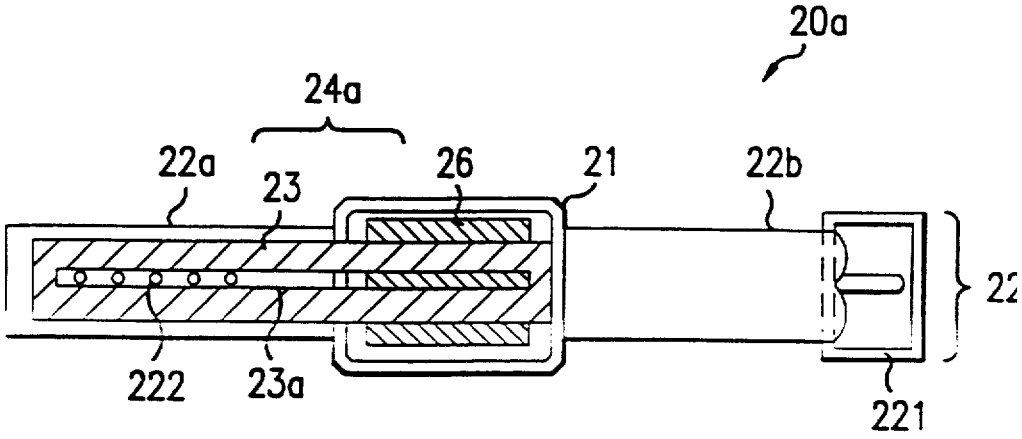
Figure 11B:
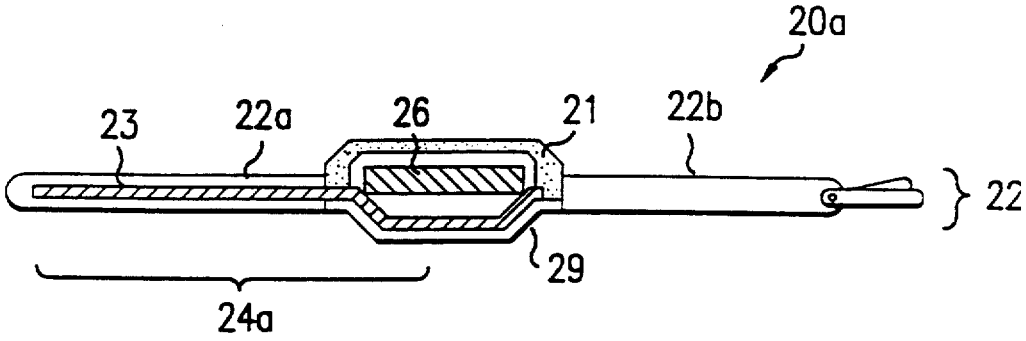
Figure 14:
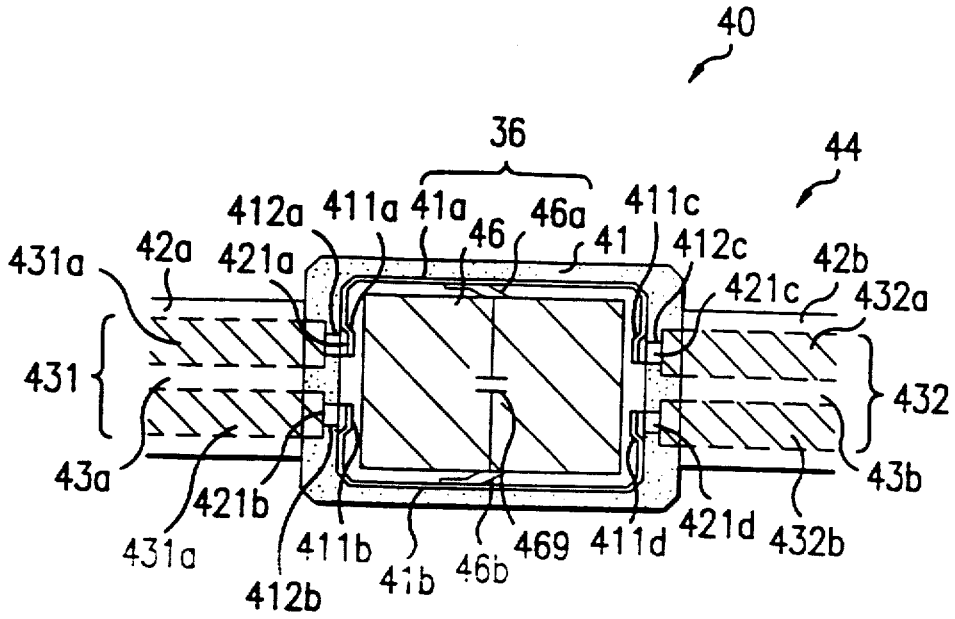
Figure 15:
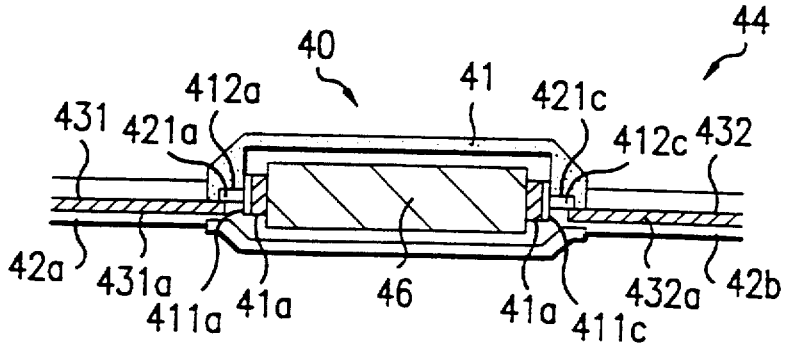
Figure 19:
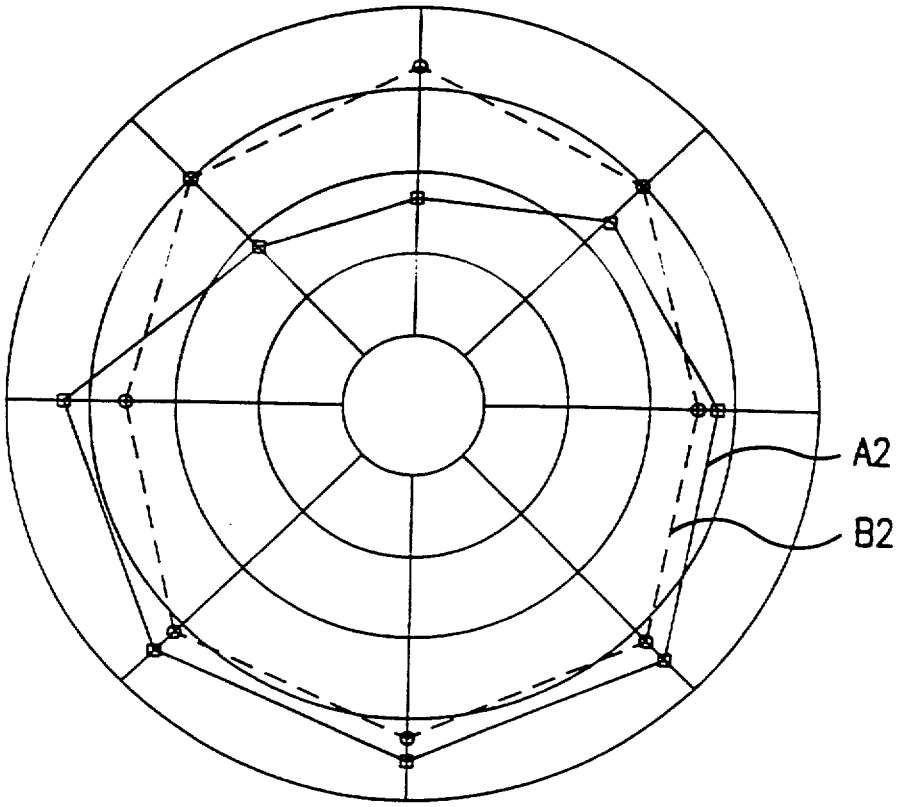

FIG. 23 is a view of an antenna for a wrist type transceiver (an antenna apparatus for wrist type transceiver) in accordance with a ninth embodiment of the present invention. The wrist type transceiver of this embodiment has the same structure as the wrist type transceiver according to the first and the fifth embodiments. It is different in the slot configuration of the conductive plate, as described in detail below.

An antenna 94 of this embodiment has a conductive plate 93, whose slot 93*a* is formed to extend in the longitudinal direction of the conductive plate. Extended sections 931*a* and 931*b*, which are formed to extend the width of the slot 93*a*, are formed at both end portions or at intermediate portions of the slot 93*a*. Therefore, the peripheral length of the slot 93*a* of antenna 94 is extended substantially. As a result, without extending the length of the antenna 94, excellent antenna gain can be obtained for an electromagnetic wave having a long wavelength. As previously described in each embodiment, a slot is formed to extend straight in the longitudinal direction of the conductive plate; however, it is acceptable to form a slanted slot in order to increase the length of the slot.

According to the construction of the wrist band, a metallic wrist band and the like, affixed through an insulator, can be used. Further, it is possible to combine each component of the wrist type transceiver in accordance with the above mentioned first and ninth embodiments.

Industrially Applicable Field

As previously described in detail, according to an antenna apparatus for a transceiver of the present invention, an antenna is formed by a conductive plate, having a strip-shaped slot formed to extend in the longitudinal direction, with a band construction for placement on the person's wrist. The conductive plate provides an antenna unit. Therefore, it is possible to obtain an excellent operation of an antenna without shifting its tuning frequency for different sized wrist bands, depending on the persons who wear it.

Further, the antenna unit can function as a slot antenna, especially as a slot antenna in the peripheral direction when it is placed on the person's wrist. As a result of its non-directional characteristics, it is suitable for use as a portable transceiver.

Further, because the antenna unit does not include a clasp as a component, it is not affected by a deterioration of the shape and the surface condition of the clasp 121 due to rust and the like. A stable operation of the antenna is obtained.

When the conductive plate is connected electrically to the inside of a casing through conductive terminals, by removing it from the casing, it is possible to exchange easily the wrist band in which the conductive plate is fixed.

When a circuit pattern, which is formed along the internal peripheral surface of the casing, is used for an electric route, the casing requires less space, therefore permitting a thinned casing to be used.

When a capacitance element is attached between both sides of a slot, without changing the antenna's structure, its tuning frequency can be adjusted. When the power is supplied by shifting the feeding positions from the center position to either end portions of the conductive plate 73, it is possible to adjust the impedance between the antenna and the transceiver circuit without changing other constructions.

When a dielectric layer is filled into the inside of the slot, or when extended sections are formed to extend the width of the slot without extending the antenna's length, good antenna gain can be obtained to an electromagnetic wave having a long wavelength. The shortened antenna can be used in order to obtain good antenna gain to an electromagnetic wave having the same wavelength. Therefore, it is possible to realize a miniaturized antenna unit.

Further, when a metal clasp of the wrist type transceiver is insulated, without affecting a tuning frequency, a stable antenna operation can be obtained.

What is claimed is:

1. An antenna apparatus for a wireless instrument comprising a wrist band fixed to an antenna element having a strip shaped conductive plate with a slot formed in a longitudinal direction of the conductive plate and a capacitance element attached between side sections of the conductive plate and extending across said slot.

2. An antenna apparatus for a wireless instrument as claimed in claim 1, wherein said capacitance element is variable and said side sections of said conductive plate oppose each other and traverse said slot.

3. An antenna apparatus for a wireless instrument as claimed in claim 2, wherein said conductive plate includes first and second side sections located on opposite sides of said slot, either side section of said conductive plate is provided with a feeding point for attachment to a wireless instrument circuit, which feeds either a positive or a negative potential, the other side section provided with a feeding point for attachment to a ground potential.

4. An antenna apparatus for a wireless instrument as claimed in claim 2, wherein said conductive plate is provided with a feeding point for a wireless instrument, in order that both side sections of said slot are fed with a balancing type circuit.

5. An antenna apparatus for a wireless instrument as claimed in claim 1, wherein said conductive plate includes first and second side sections located on opposite sides of said slot, either side section of said conductive plate is provided with a feeding point for attachment to a wireless instrument circuit which feeds either a positive or a negative potential, the other side section provided with a feeding point for attachment to a ground potential.

6. An antenna apparatus for a wireless instrument as claimed in claim 5, wherein said feeding point is shifted by a determined distance from a center portion of said conductive plate along the longitudinal direction of said conductive plate to an end portion of said conductive plate.

7. An antenna apparatus for a wireless instrument as claimed in claim 1, wherein said conductive plate includes first and second side sections located on opposite sides of said slot, and said conductive plate is provided with a feeding point for attachment to wireless instrument circuit, in order that both side sections of said slot are fed with a balancing type circuit.

8. An antenna apparatus for a wireless instrument as claimed in claim 7, wherein said feeding point is shifted by a determined distance from a center portion of said conductive plate along the longitudinal direction of said conductive plate to an end portion of said conductive plate.

9. An antenna apparatus for a wireless instrument as claimed in claim 1, wherein a dielectric material is filled in said slot.

10. An antenna apparatus for a wireless instrument as claimed in claim 1, wherein said slot includes an extended portion having a width greater than a width of a non-extended portion of said slot, in order to extend a peripheral length of said slot.

11. An antenna apparatus for a wireless instrument as claimed in claim 1, wherein a clasp is provided on a free end of said wrist band in order to couple said wrist band to a user, said clasp being insulated from said conductive plate.

12. An antenna apparatus for a wireless instrument as claimed in claim 1, wherein said capacitance element is attached to a substantially center portion of said conductive plate.

13. An antenna apparatus for a wireless instrument as claimed in claim 1, wherein said conductive plate is provided with a feeding point for the supply of electricity to said conductive plate, said feeding point being shifted a determined distance along the longitudinal direction of said conductive plate from the attachment position of said capacitance element.

14. An antenna apparatus for a wireless instrument comprising a wrist band having a first band and a second band connected to opposite sides of a casing, and at least one of said first and second bands is fixed to a slot antenna element having a strip shaped conductive plate with a slot formed in a longitudinal direction of the conductive plate.

15. An antenna apparatus for a wireless instrument as claimed in claim 14, wherein said antenna apparatus is provided with a capacitance element, which is attached between side sections of said conductive plate that oppose each other and traverse said slot.

16. An antenna apparatus for a wireless instrument as claimed in claim 15, wherein said capacitance element is variable.

17. An antenna apparatus for a wireless instrument as claimed in claim 14, wherein said conductive plate includes first and second side sections located on opposite sides of said slot, either side section of said conductive plate is provided with a feeding point for attachment to a wireless instrument circuit, which feeds either a positive or a negative potential, the other side section provided with a feeding point for attachment to a ground potential.

18. An antenna apparatus for a wireless instrument as claimed in claim 17, wherein said feeding point is shifted by a determined distance from a center portion of said conductive plate along the longitudinal direction of said conductive plate to an end portion of said conductive plate.

19. An antenna apparatus for a wireless instrument as claimed in claim 14, further comprising a capacitance element attached to said conductive plate, and wherein said conductive plate is provided with a feeding point for the supply of electricity to the conductive plate, said feeding point being shifted a determined distance along the longitudinal direction of said conductive plate from the attachment position of said capacitance element.

20. An antenna apparatus for a wireless instrument as claimed in claim 14, wherein said conductive plate includes first and second side sections located on opposite sides of said slot, and said conductive plate is provided with a feeding point for attachment to a wireless instrument, in order that both side sections of said slot are fed with a balancing type circuit.

21. An antenna apparatus for a wireless instrument as claimed in claim 20, wherein said feeding point is shifted by a determined distance from a center portion of said conductive plate along the longitudinal direction of said conductive plate to an end portion of said conductive plate.

22. An antenna apparatus for a wireless instrument as claimed in claim 14, wherein a dielectric material is filled in said slot.

23. An antenna apparatus for a wireless instrument as claimed in claim 14, wherein said slot includes an extended portion having a width greater than a width of a non-extended portion of said slot, in order to extend a peripheral length of said slot.

24. An antenna apparatus for a wireless instrument as claimed in claim 14, wherein a conductive clasp is provided on a free end of said first band in order to couple to said second band for securing said wrist band to a user, said clasp being insulated from said conductive plate.

25. An antenna apparatus for a wireless instrument as claimed in claim 14, further comprising a capacitance element attached between side sections of the conductive plate and extending across said slot, wherein said capacitance element is attached to a substantially center portion of said conductive plate.

26. An antenna apparatus for a wireless instrument comprising a wrist band having a first band and a second band connected to opposite edges of a casing, each of said first and second bands being fixed to an antenna element having a first and a second conductive plate, the first and the second conductive plates having a first slot and a second slot formed from the opposite edges of said casing and extending in a longitudinal direction of the conductive plates; wherein, at the opposite edges of said casing, said first conductive plate is divided into a first end section and a second end section by said first slot, said second conductive plate is divided into a first end section and a second end section by said second slot, respectively, and said first end sections are connected electrically to the second end sections through two electric paths located at a side of said casing.

27. An antenna apparatus for a wireless instrument as claimed in claim 26, wherein said electric paths are provided in a wiring section, the wiring section being a wiring pattern of a circuit board incorporated in said casing.

28. An antenna apparatus for a wireless instrument as claimed in claim 27, wherein said conductive plates and said wiring section are connected electrically to each other through conductive terminals fixed to at least an edge of said casing and said conductive plate.

29. An antenna apparatus for a wireless instrument as claimed in claim 26, wherein said electric paths are provided in a wiring section, the wiring section being formed along an internal peripheral side of said casing.

30. An antenna apparatus for a wireless instrument as claimed in claim 29, wherein said conductive plates and said wiring section are connected electrically to each other through conductive terminals fixed to at least an edge of said casing and said conductive plates.

31. An antenna apparatus for a wireless instrument as claimed in claim 26, wherein said first and second conductive plates and said two electrical paths define an endless antenna structure, said antenna structure being provided with a capacitance element attached between side sections of said antenna structure that oppose each other and traverse said slot.

32. An antenna apparatus for a wireless instrument as claimed in claim 31, wherein said capacitance element is a variable capacitance element.

33. An antenna apparatus for a wireless instrument as claimed in claim 26, wherein said first and second conductive plates and said two electrical paths define an endless antenna structure, said antenna structure includes first and second side sections located on opposite sides of said first and second slots, respectively, either side section is provided with a feeding point for attachment to a wireless instrument circuit which feeds either a positive or a negative potential, the other side section provided with a feeding point for attachment to a ground potential.

34. An antenna apparatus for a wireless instrument as claimed in claim 33, wherein said feeding point is shifted by a determined distance from a center portion of said antenna structure along a longitudinal direction of said antenna structure to an end portion of said antenna structure.

35. An antenna apparatus for a wireless instrument as claimed in claim 26, wherein said first and second conductive plates and said two electrical paths define an endless antenna structure, said antenna structure includes first and second side sections located on opposite sides of said first and second slots, said side sections provided with a feeding point for attachment to a wireless instrument circuit, in order that both side sections of said first and second slots are fed with a balancing type circuit.

36. An antenna apparatus for a wireless instrument as claimed in claim 35, wherein said feeding point is shifted by a determined distance from a center portion of said antenna structure along a longitudinal direction of said antenna structure to an end point of said antenna structure.

37. An antenna apparatus for a wireless instrument as claimed in claim 26, wherein a dielectric material is filled in said first and second slots.

38. An antenna apparatus for a wireless instrument as claimed in claim 26, wherein a clasp is provided on a free end of said first band in order to couple to said second band for securing said wrist band to a user, said clasp being insulated from said conductive plates.

39. An antenna apparatus for a wireless instrument as claimed in claim 26, wherein said first and second slots include an extended portion having a width greater than a width of a non-extended portion of said first and second slots, in order to extend a peripheral length of said first and second slots.

40. An antenna apparatus for a wireless instrument as claimed in claim 26, wherein said first and second end sections of each of said first and second conductive plates are provided with feeding points for attachment to a wireless instrument circuit, said wireless instrument circuit feeding a different potential to said first and second end sections of each of said first and second conductive plates.

41. An antenna apparatus for a wireless instrument as claimed in claim 26, further comprising a capacitance element attached between said first and second conductive plates, and wherein at least one of said first and second conductive plates is provided with a feeding point for the supply of electricity to the conductive plate to which said capacitance element is attached, said feeding point being shifted a determined distance along the longitudinal direction of said conductive plate from the attachment position of said capacitance element.

42. An antenna apparatus for a wireless instrument as claimed in claim 26, further comprising a capacitance element attached between side sections of one of the first and second conductive plates and extending across one of said first and second slots, wherein said capacitance element is attached to a substantially center portion of said one of the first and second conductive plates.

43. A wireless instrument comprising:

a wrist band; and an antenna fixed to the wrist band and having a conductive plate with a slot, wherein said conductive plate includes first and second sections located on opposite sides of said slot, said first and second sections being provided with feeding points for attachment to a wireless instrument circuit, said first and second sections feeding a different potential to said wireless instrument circuit.

44. The wireless instrument of claim 43, wherein said slot is centrally located in said conductive plate so that said conductive plate is in the shape of an endless loop.

45. The wireless instrument of claim 43, wherein said slot extends from one end of said conductive plate so that said one end includes an opening.

46. The wireless instrument of claim 45, wherein said one end of said conductive plate is located adjacent to an end of said wrist band attached to said casing.

47. The wireless instrument of claim 46, wherein the end of said wrist band attached to said casing includes a first electrical connector coupled to said one end of said conductive plate, and said casing includes a second electrical connector coupled to said transceiver circuit block, said first electrical connector and said second electrical connector being selectively connectable to each other.

48. The wireless instrument of claim 43, wherein said wrist band includes a first band attached to a first side of a casing, a second band attached to a second side of said casing, and a clasp for attaching said first band to said second band, said conductive plate attached to at least one of said first and second bands.

49. The wireless instrument of claim 48, wherein said antenna includes a single slotted conductive plate located in only one of said first and second bands.

50. The wireless instrument of claim 48, wherein said antenna includes a single slotted conductive plate located in one of said first and second bands and extending into said casing.

51. The wireless instrument of claim 48, wherein said antenna includes a single slotted conductive plate located in both of said first and second bands and extending across said casing.

52. The wireless instrument of claim 48, wherein said antenna includes a first and a second slotted conductive plate located in said first and second bands, respectively, said first and second conductive plates coupled to each other through said casing.

53. The wireless instrument of claim 52, wherein said casing includes a circuit pattern that couples said first and second conductive plates to each other through said casing.

54. The wireless instrument of claim 53, wherein said circuit pattern includes spring portions adjacent to connections with said first and second conductive plates to absorb stress.

55. The wireless instrument of claim 48, wherein said clasp is electrically isolated from said conductive plate.

56. The wireless instrument of claim 43, wherein said antenna is provided with a capacitance element attached between said first and second sections of said conductive plate and traversing said slot.

57. The wireless instrument of claim 56, wherein said capacitance element is a variable capacitance element.

58. The wireless instrument of claim 43, wherein said first section has a first feeding point for attachment to said wireless instrument circuit said first section feeds either a positive or a negative potential to said wireless instrument circuit, and said second section has a second feeding point for attachment to a ground of said wireless instrument circuit.

59. The wireless instrument of claim 58, wherein said first and second feeding points are shifted by a determined distance from a center portion of said conductive plate along the longitudinal direction of said conductive plate to an end portion of said conductive plate.

60. The wireless instrument of claim 43, wherein said wireless instrument circuit is a balancing type circuit that receives different voltage potentials from said first and second feeding points, respectively.

61. The wireless instrument of claim 50, wherein said first and second feeding points are shifted by a determined distance from a center portion of said conductive plate along the longitudinal direction of said conductive plate to an end portion of said conductive plate.

62. The wireless instrument of claim 43, wherein a dielectric material is filled in said slot.

63. The wireless instrument of claim 43, wherein said slot includes an extended portion having a width greater than a width of a non-extended portion of said slot, in order to increase a peripheral length of said slot.

64. The wireless instrument as claimed in claim 43, further comprising a casing containing a wireless circuit block.

65. A wireless instrument as claimed in claim 43, further comprising a capacitance element attached between said first and second sections of the conductive plate and extending across said slot, wherein said capacitance element is attached to a substantially center portion of said conductive plate.

66. An antenna apparatus for a wireless instrument comprising:

a wrist band;

an antenna element fixed to the wrist band having a conductive plate with a slot, wherein said conductive plate includes first and second sections located on opposite sides of said slot, said first and second sections being provided with feeding points for attachment to a wireless instrument circuit, said wireless instrument circuit feeding a different potential to said first and second sections.

67. An antenna apparatus for a wireless instrument as claimed in claim 66, further comprising capacitance element attached between said first and second sections, and said feeding points being shifted a determined distance along the longitudinal direction of said conductive plate from the attachment position of said capacitance element.

68. An antenna apparatus for a wireless instrument as claimed in claim 66, further comprising a capacitance element attached between said first and second sections of the conductive plate and extending across said slot, wherein said capacitance element is attached to a substantially center portion of said conductive plate.

69. An antenna apparatus for a wireless instrument comprising:

a wrist band; and an antenna fixed to the wrist band, the antenna element having a conductive plate with a slot, wherein said conductive plate includes first and second portions located on opposite sides of said slot; and said first and second portions being provided with feeding points for attachment to a wireless instrument circuit, said feeding points being shifted by a predetermined distance from a center portion of said conductive plate when attached to said wireless instrument circuit.

70. The antenna apparatus for wireless instrument of claim 69, further comprising a capacitance element attached between said first and second portions.

71. The antenna apparatus of claim 69, wherein said wireless instrument circuit is a balancing type circuit.

72. The antenna apparatus of claim 71, wherein said wireless instrument circuit feeds a different potential to said first and second portions at said feeding points.

73. An antenna apparatus for a wireless instrument as claimed in claim 69, wherein said first portion has a first feeding point for attachment to said wireless instrument circuit, said first portion feeds either a positive or a negative potential to said wireless instrument circuit, and said second portion has a second feeding point for attachment to a ground of said wireless instrument circuit.

74. An antenna apparatus for a wireless instrument as claimed in claim 69, further comprising a capacitance element attached between said first and second sections of the conductive plate and extending across said slot, wherein said capacitance element is attached to a substantially center portion of said conductive plate.

75. An antenna apparatus for a wireless instrument comprising:

a wrist band fixed to a slot antenna element, the antenna element consisting of only one strip shaped conductive plate with a slot formed in a longitudinal direction of the conductive plate.

76. An antenna apparatus for a wireless instrument as claimed in claim 75, further comprising a capacitance element attached between side sections of the conductive plate and extending across slot, wherein said capacitance element is attached to a substantially center portion of said conductive plate.

77. An antenna apparatus for a wireless instrument comprising:

a wrist band fixed to a slot antenna element having a strip shaped conductive plate with a slot formed in a longitudinal direction of the conductive plate, said conductive plate including first and second portions located on opposite sides of said slot; and circuit means for supplying a first potential to said first portion and a second potential, different from said first potential, to said second portion, so that said antenna element operates as a slot antenna.

78. An antenna apparatus for a wireless instrument as claimed in claim 77, further comprising a capacitance element attached between said first and second portions of the conductive plate and extending across said slot, wherein said capacitance element is attached to a substantially center portion of said conductive plate.

79. A wireless instrument comprising:

a wrist band; and an antenna fixed to the wrist band and having a conductive plate with a slot, wherein said conductive plate includes first and second sections located on opposite sides of said slot, said first and second sections being provided with feeding points for attachment to a wireless instrument circuit, said wireless instrument circuit feeding a different potential to said first and second sections.

80. A wireless instrument as claimed in claim 79, further comprising a capacitance element attached between said first and second sections of the conductive plate and extending across said slot, wherein said capacitance element is attached to a substantially center portion of said conductive plate.

* * * * *

UNITED STATES PATENT AND TRADEMARK OFFICE

CERTIFICATE OF CORRECTION

PATENT NO. : 5,465,098

DATED : November 7, 1995

INVENTOR(S) : Teruhiko Fujisawa, et al

It is certified that error appears in the above-identified patent and that said Letters Patent is hereby corrected as shown below:

Delete Drawing Sheets 2,3,4,6,8, and 11, and substitute therefor the Drawing Sheets, consisting of FIGS. 3,4,5,6,7,8,9,11a,11b,14,15, and 19, as shown on the attached pages.

Signed and Sealed this

Twenty-seventh Day of February, 1996

*Attest:*

Bruce Lehman

BRUCE LEHMAN

*Attesting Officer*

*Commissioner of Patents and Trademarks*